United States Patent [19]

Arai et al.

[11] 4,269,936

[45] May 26, 1981

[54] PROCESS OF FORMING YELLOW PHOTOGRAPHIC IMAGES

[75] Inventors: Atsuaki Arai; Yasushi Oishi; Kiyoshi Nakazyo; Atsushi Sugizaki; Akio Okumura, all of Minami-ashigara, Japan

[73] Assignee: Fuji Photo Film Co., Ltd., Minami-ashigara, Japan

[21] Appl. No.: 319,806

[22] Filed: Dec. 29, 1972

[30] Foreign Application Priority Data

Dec. 28, 1971 [JP] Japan ..... 47-3039

[51] Int. Cl.[3] ..... G03C 1/40

[52] U.S. Cl. ..... 430/389; 430/557; 430/558

[58] Field of Search ..... 96/100, 56.2, 56.3, 96/56.4, 56.5; 430/389, 557, 558

[56] References Cited

U.S. PATENT DOCUMENTS

| | | | |
|---|---|---|---|
| 3,328,419 | 6/1967 | Anderson | 96/100 |
| 3,615,603 | 10/1971 | Iwama et al. | 96/100 |
| 3,730,722 | 5/1973 | Inoue et al. | 96/100 |
| 3,738,840 | 6/1973 | Anderson | 96/100 |
| 3,973,968 | 8/1976 | Fujiwhara et al. | 430/558 |
| 4,057,432 | 11/1977 | Fujiwhara et al. | 430/558 |

FOREIGN PATENT DOCUMENTS

| | | | |
|---|---|---|---|
| 2057941 | 6/1971 | Fed. Rep. of Germany | 96/56.6 |

*Primary Examiner*—J. Travis Brown

*Attorney, Agent, or Firm*—Sughrue, Rothwell, Mion, Zinn and Macpeak

[57] ABSTRACT

The process of forming a dye image by developing an image-exposed silver halide photographic emulsion layer by an aromatic primary amine color developing agent in the presence of the yellow dye forming coupler shown by the general formula wherein $R^1$ represents an aromatic group, $R^2$ represents an aromatic group or a heterocyclic group, and Z represents the non-metallic atom or atoms necessary for forming a 4-membered ring, a 5-membered ring or a 6-membered ring together with in the above formula. A photographic element containing such a yellow-forming coupler.

25 Claims, 2 Drawing Figures

FIG. 1 EQUIVALENCY
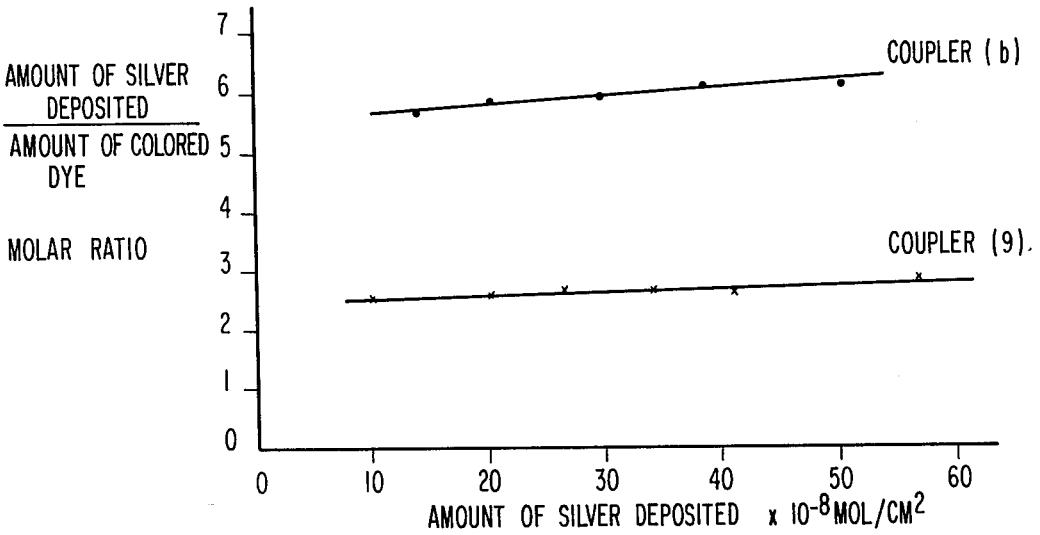
FIG. 2 EQUIVALENCY
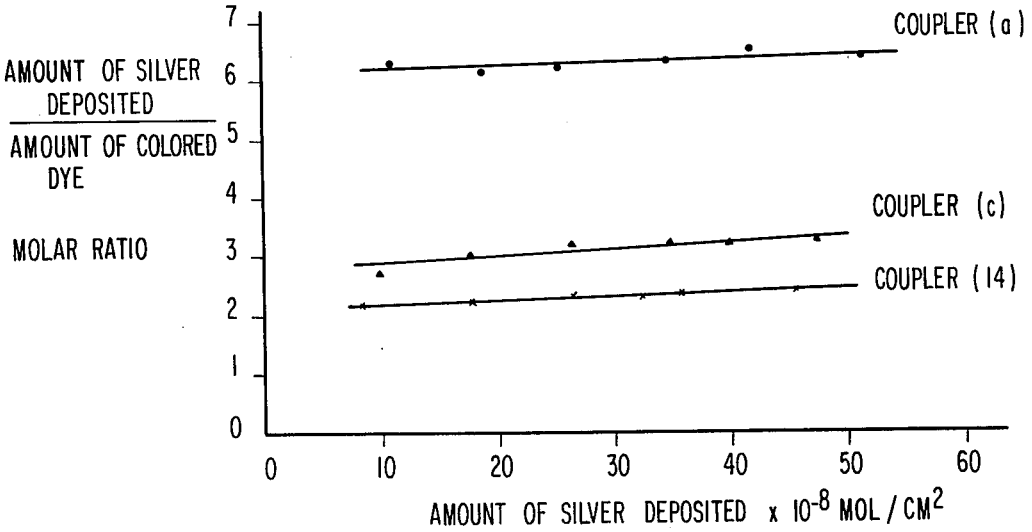

PROCESS OF FORMING YELLOW PHOTOGRAPHIC IMAGES

BACKGROUND OF THE INVENTION

1. Field of the Invention

The present invention relates to a process of forming a color photographic image, more particularly to a process of forming a color photographic image using a novel yellow-forming coupler, and a photographic element containing such coupler.

2. Description of Prior Art

For the formation of a color photographic image by a subtractive color process, a step is utilized in which the silver halide grains in an exposed silver halide photographic emulsion layer are reduced by a developing agent, generally an aromatic primary amine compound, in particular an N,N-di-substituted p-phenylenediamine compound, and the oxidation product of the developing agent formed at the same time causes a coupling reaction with color-forming couplers to give cyan, magenta, and yellow images.

Each coupler used in the color developing process is a compound having a phenolic hydroxyl group, an anilinic amine group, or an active methylene group which yields, by oxidative coupling with the aromatic primary amine developing agent, a dye capable of absorbing light in a visible wave length region.

A yellow dye image absorbs a blue light component in a wave length region of from about 400 millimicrons to about 500 millimicrons. Known yellow-forming couplers include $\beta$-ketoacetoacetic acid esters, $\beta$-diketones, N,N-malondiamides, $\alpha$-acylacetamides, etc.

Among these yellow-forming couplers, benzoylacetamide type compounds have been widely used as good yellow-forming couplers in the field of color photography. Almost all of these yellow-forming couplers are 4-equivalent couplers, that is, couplers which require 4 mols of exposed silver halide as an oxidizing agent for forming one mol of azomethine dye. However, the incorporation of a large amount of silver halide in a photosensitive emulsion layer is accompanied with disadvantages, i.e., light scattering in the emulsion layer increases to reduce the sharpness of the image formed and the thickness of the emulsion layer increases to reduce the processing rate of the photographic light sensitive material. Furthermore, such a type of yellow-forming coupler also has the fault that the formation of the dye by the coupler is not completed in a color development which requires a strong oxidizing agent in a subsequent processing step.

In order to improve those faults, it has been proposed to use a so-called 2-equivalent coupler, that is, a coupler which requires only two mols of exposed silver halide to form one mol of methine dye.

A 2-equivalent yellow coupler has the structure where one of the hydrogen atoms of the active methylene group is substituted for by a coupling off or splitting off group. As examples of such coupling off groups, a fluorine atom is described in U.S. Pat. No. 3,277,155; a substituted phenoxy group in U.S. Pat. No. 3,408,194; an acyloxyl group in U.S. Pat. No. 3,447,928; a sulfoxyl group in U.S. Pat. No. 3,415,652; and also the compound shown by the following formula

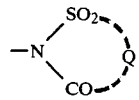

in West German Patent Application (OLS) No. 2,057,941.

The couplers disclosed in the above U.S. Patents and in U.S. Pat. Nos. 3,265,506 and 3,253,924 also have groups analogous to $R^1$ and $R^2$ in the present invention, and serve to illustrate the wide class of groups which can serve as acceptable $R^1$ and $R^2$ groups in the present invention.

However, many of these known couplers have faults, i.e., they are insufficient in coupling reactivity, they give high color fog, the coupling activity of the couplers in photographic lightsensitive materials gradually reduces due to the instability of the couplers themselves, they cause stain, the yellow dyes formed from such couplers are weak in preservation stability, and/or they are not easily produced. In short, many of such couplers are not always satisfactory.

SUMMARY OF THE INVENTION

The first object of this invention is, therefore, to provide a novel yellow-forming coupler suitable for color photography using the color subtraction process.

The second object of this invention is to provide a process of forming a dye image by developing a silver halide photographic emulsion layer in the presence of such a novel yellow-forming coupler.

The third object of this invention is to provide a color photographic light-sensitive material having a silver halide emulsion layer containing such a novel yellow-forming coupler.

The fourth object of this invention is to provide a color developer containing such a novel yellow-forming coupler.

The fifth object of this invention is to provide a process of reducing the content of silver halide incorporated in a silver halide photograhic emulsion by using such a novel yellow-forming coupler, thereby improving the sharpness of the photographic image obtained.

The sixth object of this invention is to provide a color photographic light-sensitive material suitable for quick color development processing using a blix bath containing a weak oxidizing agent and a silver complex salt-forming agent.

The seventh object of this invention is to provide a process of forming a yellow dye image having spectral absorption characteristics suitable for color reproduction by a subtractive color process which image has excellent stability.

The foregoing objects are accomplished in accordance with the present invention by providing a photographic element and a method for the formation of dye images where a silver halide photographic emulsion is processed using an aromatic primary amino developer in the presence of an (aromatic acyl) acetoamide compound substituted in the $\alpha$-position by a diacylamino group.

More particularly, the method according to the present invention involves processing a silver halide photographic emulsion with an aromatic primary amino developing agent, in the presence of a novel yellow-forming coupler having a diacylamino substituent in the α-position thereof which may be represented by the following General Formula (I)

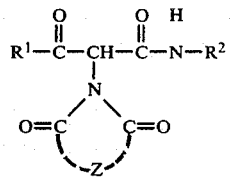

General Formula (I)

wherein $R^1$ is an aryl group, $R^2$ is an aryl group or a heterocyclic group, and Z is the non-metallic atoms necessary to form, together with the

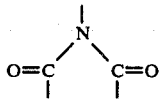

moiety in the formula, a 4-membered, 5-membered or 6-membered substituted or unsubstituted ring. $R^1$, $R^2$ and Z will have the same meaning in all formulae hereafter discussed unless otherwise indicated.

DESCRIPTION OF THE PREFERRED EMBODIMENTS

In the above-described General Formula (1), the group $R^1$ represents an aryl group such as a phenyl group or a substituted phenyl group. The substituents which can be present on the phenyl group include, in addition to the monovalent substituents hereinafter described, divalent moieties which together with the phenyl nucleus form a condensed ring system

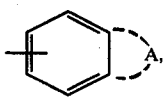

in which A represents the atoms necessary to form an aromatic condensed ring system. Such aryl groups having a condensed ring system include naphthyl, quinolyl, iso-quinolyl, chromanyl, coumarinyl and tetrahydronaphthyl groups. General Formula (I) also includes those derivatives in which two residual groups each of the same formula

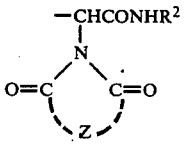

are bound either to an arylene group, or two aryl groups combined via a bivalent group. In such cases the coupler can be represented by the following general formula:

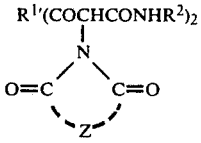

wherein $R^{1'}$ represents an arylene group or —Y—Y'—Y—, wherein Y represents an arylene group and Y' represents a bivalent group.

Examples of such bivalent groups are $—CH_2—$, —O—, —NHCONH— and the like.

The group $R^2$ represents an aryl group such as a phenyl group or a substituted phenyl group. The substituents which can be present on the phenyl group include, in addition to the monovalent substituents hereinafter described, divalent moieties which together with the phenyl nucleus form a condensed ring system

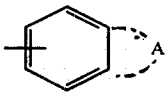

in which A represents the atoms necessary to form an aromatic condensed ring system. Such aryl group having a condensed ring system include naphthyl, quinolyl, iso-quinolyl, chromanyl, coumarinyl and tetrahydronaphthyl groups. General Formula (I) also includes those derivatives in which two residual groups each of the same formula

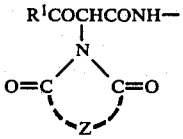

are bound either to an arylene group, or two aryl groups combined via a bivalent group. In such cases the coupler can be represented by the following general formula:

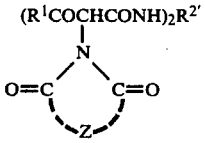

wherein $R^{2'}$ represents an arylene group, or —Y—Y'—Y—, wherein Y represents an arylene group and Y' represents a bivalent group. Examples of such bivalent groups are $—CH_2—$, —O—, —NHCONH— and the like.

The monovalent substituents on the phenyl nucleus of the groups $R^1$ and $R^2$ can be selected from a broad range of residual groups. Such substituents include, for example, halogen atoms, alkyl groups, alkenyl groups, alkoxy groups, aryl groups, aryloxy groups, alkylcarbonyl groups, arylcarbonyl groups, alkylsulfonyl groups, arylsulfonyl groups, carboxyl groups, thiocyano groups, alkoxycarbonyl groups, carbamyl groups, sulfo groups, sulfamyl groups, acylamino groups, ureido groups, sulfonamide groups, amino groups, nitro groups, cyano groups, hydroxyl groups, acyl groups, aryloxycarbonyl groups, alkoxysulfonyl groups, aryloxysulfonyl groups and sulfonamino groups. The positions occupied by a hydrogen atom or atoms in these groups may be further substituted, i.e., a hydrogen atom or atoms can be replaced by a substituent giving rise to a substituted group. The phenyl nucleus of the groups $R^1$ and $R^2$ is preferably substituted by one or more of the above-described substituents.

The phenyl group represented by the following formula is a preferred $R^1$ group:

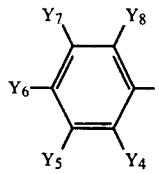

wherein $Y_4$ and $Y_8$ each represents a hydrogen atom, an alkyl group ($C_1$–$C_{32}$) or an alkoxy group ($C_1$–$C_{32}$), and $Y_5$, $Y_6$ and $Y_7$ each represents a hydrogen atom, an alkyl group ($C_1$–$C_{32}$), an alkoxy group ($C_1$–$C_{32}$), an aryloxy group (such as phenoxy, tolyloxy, amylphenoxy, diamylphenoxy, nonylphenoxy, methoxyphenoxy, chlorophenoxy, naphthoxy, etc.), an amino group, an alkylamino group ($C_1$–$C_{32}$) or an acylamino group ($C_1$–$C_{32}$).

The phenyl group represented by the following formula is a preferred $R^2$ group:

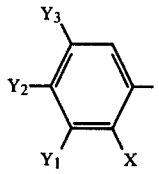

wherein X represents a halogen atom, an alkoxy group ($C_1$–$C_{32}$), an aryloxy group ($C_1$–$C_{32}$), a di-substituted amino group ($C_1$–$C_{32}$), and $Y_1$, $Y_2$ and $Y_3$ each represents a hydrogen atom, a halogen atom, an alkyl group ($C_1$–$C_{32}$), an alkenyl group ($C_1$–$C_{32}$), an alkoxy group ($C_1$–$C_{32}$), an aryl group (such as phenyl, tolyl, amylphenyl, diamylphenyl, nonylphenyl, methoxyphenyl, chlorophenyl, naphthyl, etc.), aryloxy (such as phenoxy, tolyloxy, amylphenoxy, diamylphenoxy, nonylphenoxy, methoxyphenoxy, chlorophenoxy, naphthophenoxy, etc.), alkylcarbonyl ($C_1$–$C_{32}$), arylcarbonyl, alkylsulfonyl ($C_1$–$C_{32}$), arylsulfonyl, carboxy, alkoxycarbonyl ($C_1$–$C_{32}$), carbamyl ($C_1$–$C_{32}$), sulfo, sulfamyl ($C_1$–$C_{32}$), acylamino ($C_1$–$C_{32}$), ureido ($C_1$–$C_{32}$), sulfonamide ($C_1$–$C_{32}$), amino, nitro or cyano. The heterocyclic group which may be represented by the group $R^2$ is bound through a carbon atom of the heterocyclic ring to the residual group $R^1$

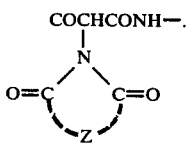

This carbon atom is a member of the conjugated electron system of the ring, i.e., a carbon atom which thus exhibits an aromatic character. Such heterocyclic groups include those of the thiophene type, such as a 2-thiophenyl, a 3-thiophenyl, a 2-benzothiophenyl, a 3-benzothiophenyl, a 2-naphthothiophenyl, a 3-naphthothiophenyl, or a 3-thiophenyl group; those of the furan type, such as a 2-furyl, a 3-furyl, a 2-benzofuranyl, a 3-benzofuranyl, a 1-isobenzofuranyl or a 3-isobenzofuranyl group, those of the pyran type, such as a 3-pyranyl, a 4-pyranyl, a 5-pyranyl or a 6-pyranyl group, those of the chromene type, such as a 3-chromenyl or a 4-chromenyl group, those of the pyrrole type, such as a 3-pyrrolyl group; those of the pyrazole type such as a 3-pyrazolyl or a 4-pyrazolyl group; those of the pyridine type, such as a 2-pyridyl, a 3-pyridyl, a 4-pyridyl, a 2-quinolyl, a 3-quinolyl, a 4-quinolyl, a 1-isoquinolyl, a 3-isoquinolyl or a 4-isoquinolyl group; those of the pyrazine type, such as a 2-pyrazinyl or a 2-quinoxalinyl group; those of the pyrimidine type, such as a 2-pyrimidinyl, a 4-pyrimidinyl, a 5-pyrimidinyl, a 2-quinazolinyl or a 4-quinazolinyl group; those of the pyridazine type, such as a 2-pyridazinyl, a 3-pyridazinyl, a 3-cinnolinyl or a 4-cinnolinyl group; those of the indolidine type, such as a 1-indolidinyl, a 2-indolidinyl, a 3-indolidinyl, a 5-indolidinyl, a 6-indolidinyl or a 7-indolidinyl group; those of the perimidine type, such as a 2-perimidinyl group; those of the thiazole type, such as a 2-thiazolyl, a 2-benzothiazolyl, a 3-isothiazolyl, a 4-isothiazolyl or a 5-isothiazolyl group; those of the imidazole type, such as a 2-benzoimidazolyl group; those of the oxazole type, such as a 2-oxazole group; those of the 1,3,5-triazine type, such as a 1,3,5-triazinyl group; and those of the oxazine type such as a 2-oxazinyl group. These heterocyclic groups may be further substituted by any suitable substituent(s), for example, halogen atoms, alkyl groups, alkylcarbonyl groups, alkenyl groups, alkoxy groups, alkylsulfonyl groups, aryl groups, aryloxy groups, arylcarbonyl groups, arylsulfonyl groups, carboxyl groups, alkoxycarbonyl groups, carbamyl groups, sulfo groups, sulfamyl groups, acylamide groups, ureido groups, sulfonamide groups, amino groups, nitro groups, cyano groups, thiocyano groups, hydroxyl groups, acyl groups, aryloxycarbonyl groups, acylamino groups, alkoxysulfonyl groups, aryloxysulfonyl groups and sulfoamino groups.

Another embodiment of General Formula (I), includes those derivatives in which two residual groups

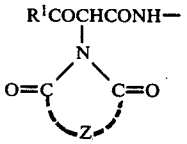

are bound to a heterocyclic group, to two heterocyclic groups combined directly with each other or to two heterocyclic groups combined via a bivalent group. In this case, the couplers may be represented by the following general formula:

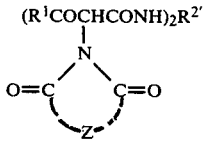

wherein $R^{2'}$ represents a divalent heterocyclic group.

General formula (I) further includes bis-compounds such as those wherein two coupler groups $R^1COCH-CONHR^2$ are bonded through Z, e.g., see yellow-forming coupler (43) described below.

In a preferred embodiment, the diacylamino group is selected from dicarboxylic acid imido groups having the following General Formulae (II) to (XIII)

(II)

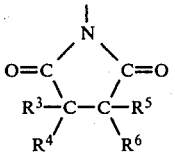

(III)

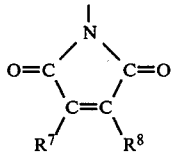

(IV)

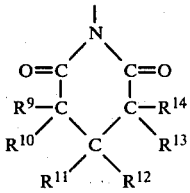

(V)

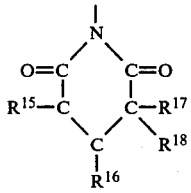

(VI)

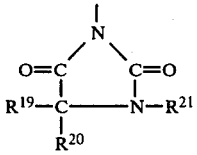

(VII)

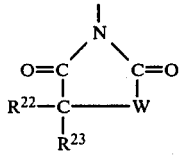

(VIII)

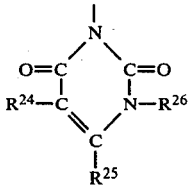

(IX)

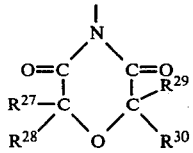

(X)

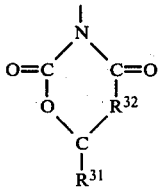

(XI)

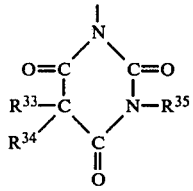

(XII)

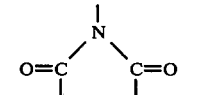

(XIII)

and

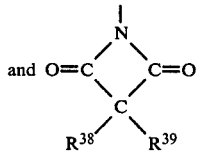

In the above General Formulae (II) to (XIII), $R^3$, $R^4$, $R^5$, $R^6$, $R^7$, $R^8$, $R^9$, $R^{10}$, $R^{11}$, $R^{12}$, $R^{13}$, $R^{14}$, $R^{15}$, $R^{16}$, $R^{17}$, $R^{18}$, $R^{19}$, $R^{20}$, $R^{22}$, $R^{23}$, $R^{24}$, $R^{25}$, $R^{27}$, $R^{28}$, $R^{29}$, $R^{30}$, $R^{31}$, $R^{32}$, $R^{33}$, $R^{34}$, $R^{38}$ and $R^{39}$ are each a monovalent substituent such as a hydrogen atom, a halogen atom such as a fluorine, chlorine or bromine atom, an alkyl group such as a substituted or an unsubstituted alkyl group having from 1 to about 32 carbon atom, preferably having from 1 to about 20 carbon atoms, an alkoxy group, an aryl group, an aryloxy group, a sulfo group, or a carboxyl group.

In formulae VI, VIII, XI and XII, $R^{21}$, $R^{26}$, $R^{35}$, $R^{36}$ and $R^{37}$ each represents a hydrogen atom, an alkyl group such as a substituted or unsubstituted alkyl group having from 1 to about 32 carbon atoms, preferably from 1 to about 20 carbon atoms, or an aryl group.

Moreover, groups $R^3$ and $R^5$ in General Gormula (II), $R^7$ and $R^8$ in General Formula (III), $R^9$ and $R^{11}$, and $R^{12}$ and $R^{13}$ in General Formula (IV), $R^{15}$ and $R^{16}$ and $R^{16}$ and $R^{17}$ in General Formula (V), $R^{24}$ and $R^{25}$ in General Formula (VIII), and $R^{31}$ and $R^{32}$ in General Formula (X) may be combined together to form a 5- to 6-membered ring which may be either saturated or unsaturated. Examples of such rings include a benzene ring, a pyridine ring, a cyclohexane ring, a furan ring, a bicycloheptane ring, a bicycloheptene ring and a cyclohexene ring.

W in General Formula (VII) represents an oxygen atom or a sulfur atom.

Specific examples of the residual group in the General

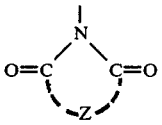

Formula (I) are provided at a later portion of this specification.

The two-equivalent couplers of the present invention represented by General Formula I are derived from four-equivalent couplers represented by the following General Formula (I') and are linked at their coupling position by a single bond to a cyclic diacylamino group

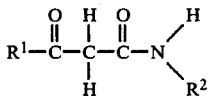

(I')

wherein $R^1$ and $R^2$ are as defined in Formula I. The four-equivalent couplers represented by formula (I') are very well known in the photographic art. Numerous substituents have been provided on $R^1$ and $R^2$ in order to improve the characteristics of the coupler per se and those of the dyes formed from the couplers. Examples of these couplers can be found in the following references. "Mitteilungen aus den Forshungs-laboratorien der AGFA" by W. Pelz, Band 3, pages 112–126 (1961), U.S. Pat. Nos. 3,409,439, 3,551,155, 3,551,156 and 3,649,276; British Pat. Nos. 1,961,156 and 1,286,411; Japanese Patent Publication Nos. 39-2,839 and 40-6,030; U.S. Pat. Nos. 2,319,426, 2,331,326, 2,350,138, 2,359,332, 2,376,679, 2,407,210, 2,464,297, 2,472,913, 2,868,829, 2,875,057, 2,953,576, 3,056,674, 3,056,675, 3,077,403, 3,341,331, 3,369,899, 3,393,041, 3,615,606, 3,619,190, 3,623,876, 3,645,742, 3,660,095, and 3,669,671; and British Pat. Nos. 805,505 and 1,187,860, all of which are incorporated herein.

Since the two-equivalent couplers of formula (I) provide the same azomethine dyes as those from the four-equivalent couplers of formula (I'), it can be expected that the $R_1$ and $R_2$ groups which provide dyes having desirable properties are also useful in the couplers of the present invention. Since the two-equivalent couplers of formula (I) are only modified by substituting the diacylamino group for one $\alpha$-position hydrogen atom, it can also be expected that any of the $R_1$ and $R_2$ groups of formula (I') may be used as $R_1$ and $R_2$ in the couplers of the present invention.

It has been surprizingly found, however, that by substituting the diacylamino group for one α-position hydrogen atom the remaining hydrogen atom at the α-position receives an electronic effect and the coupler generally shows a decrease in its pKa value of about 3–4. Thus, in the couplers of the present invention $R^1$ and $R^2$, whether aryl ($R^1$ and $R^2$) or heterocyclic ($R^2$), can be substituted with an electron-donating group which does not reduce the coupling activity such as alkoxy group, amino group or N-substituted amine group and maintain their sufficient coupling reactivity. It will be understood that $R^1$ and $R^2$ should not include a group adversely affecting the photographic emulsion such as a mercapto group, a disulfide group or a peroxycarboxy group.

Typical specific examples of dicarboxylic acid imide groups are illustrated below:

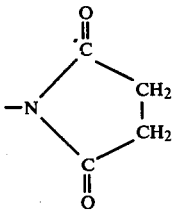

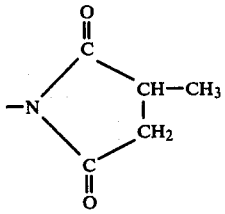

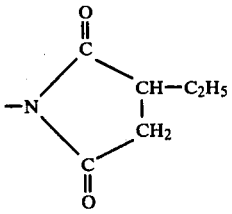

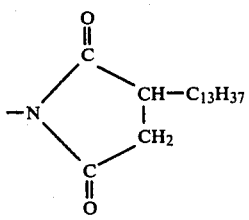

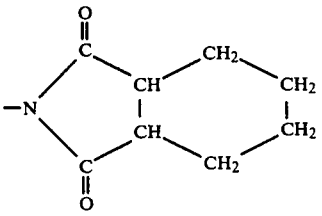

-continued

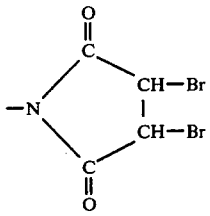

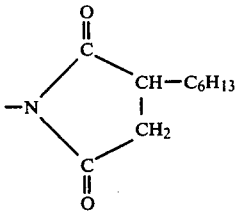

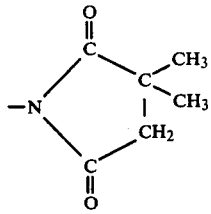

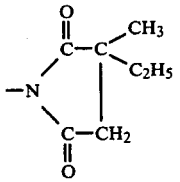

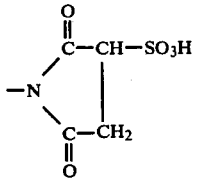

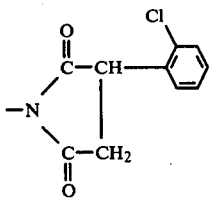

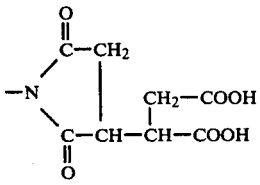

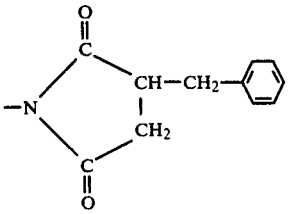

-continued
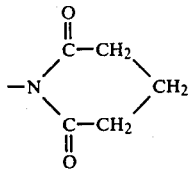
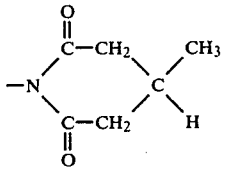
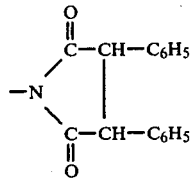
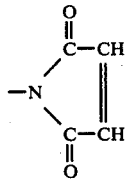
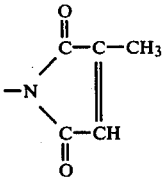
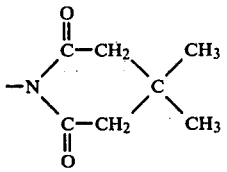
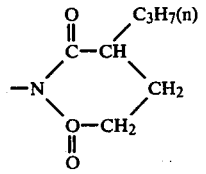
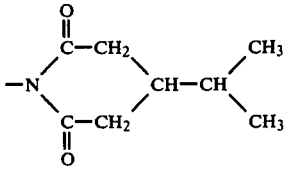
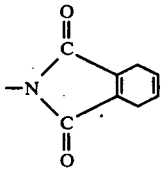
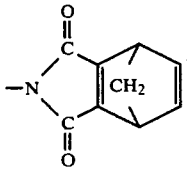
-continued
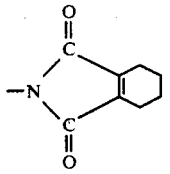
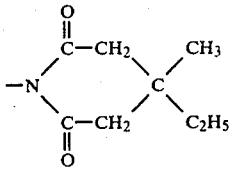
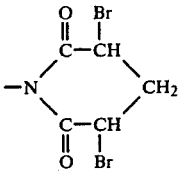
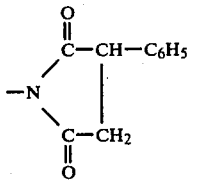
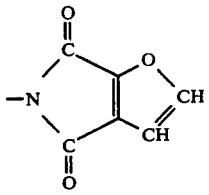
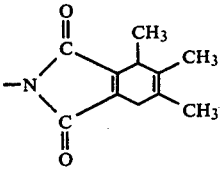
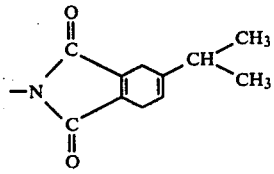
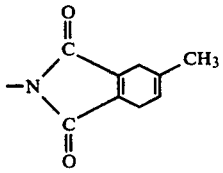
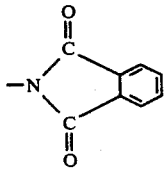
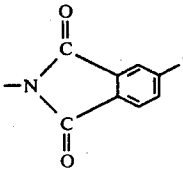

-continued
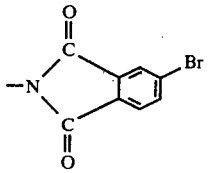
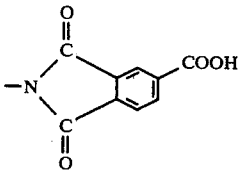
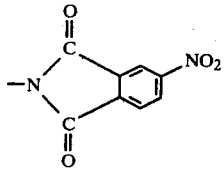
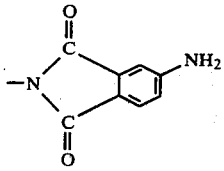
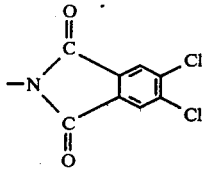
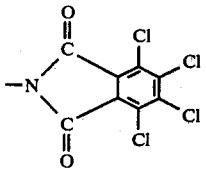
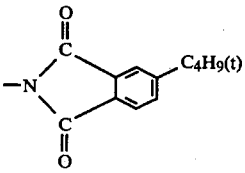
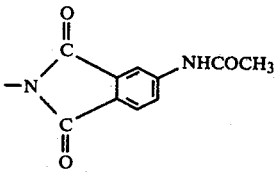
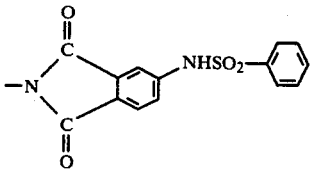
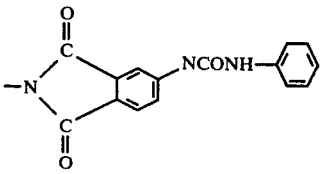
-continued
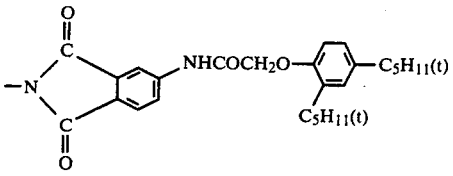
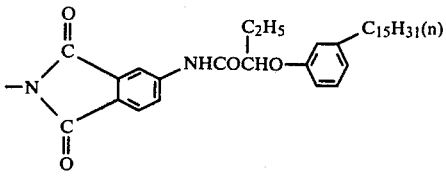
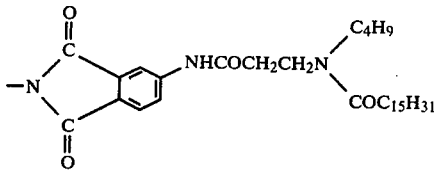
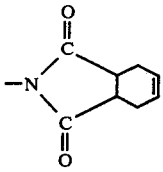
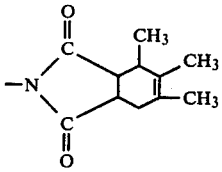
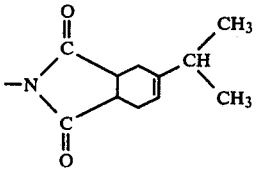
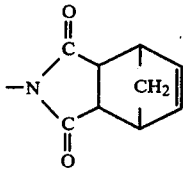
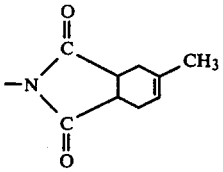
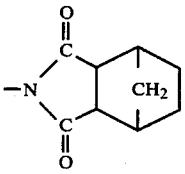
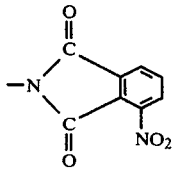

-continued

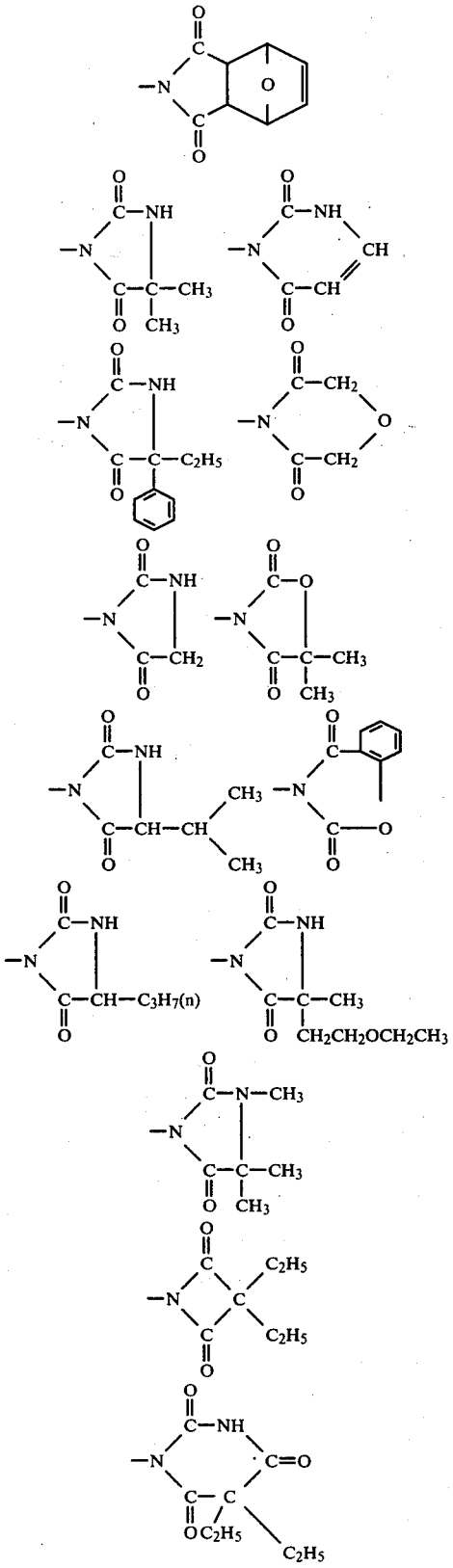

The process of forming yellow images according to this invention may be divided into two modes, one where the couplers are present in the photographic emulsion layers of a photographic light-sensitive material and one where the couplers are present in color developers. In the former mode, the couplers are usually incorporated in silver halide photographic emulsion layers during the manufacture of the color photographic light-sensitive materials, and in the latter mode couplers are usually dissolved in color developers and they diffuse into the silver halide photograhic emulsion layers of color photographic light-sensitive materials during development processing.

When the couplers are present in an emulsion layer, each coupler must be fixed in a specific emulsion layer. In other words, such a coupler must have a diffusion resistance since otherwise the coupler diffuses into other silver halide emulsion layers of the photographic light-sensitive material and causes a coupling reaction in emulsion layers which have different spectral sensitivities than the emulsion layer in which the coupler was originally present, and thus greatly reduces the color reproducing faculty of the light-sensitive material.

In order to provide a diffusion resisting property to a coupler, a hydrophobic group having 8–32 carbon atoms is introduced in the molecule of the coupler. Such a group is usually called a "ballast" or "ballasting" group. The ballast group combines with the skeleton structure of the coupler directly or through an amino bond, an ether bond, a thioether bond, a carbonamido bond, a sulfonamide bond, an urea bond, an ester bond, an imide bond, a carbonyl bond or a sulfonyl bond, in any one of $R^1$, $R^2$ or Z.

Any known ballast groups can be used in the yellow-forming couplers of this invention. Typical examples of such ballast groups are given below:

(i) Alkyl groups and alkenyl groups, such as

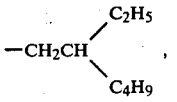

$-C_{12}H_{25}$, $-C_{16}H_{33}$ and $-C_{17}H_{33}$. See also FIAT Final Report No. 934.

(ii) Alkoxyalkyl groups, for example as described in the specification of Japanese Patent Publication No. 27,563/1964. Typical examples thereof are: $-(CH_2)_3O(CH_2)_7CH_3$ and

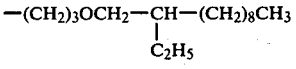

(iii) Alkylaryl groups such as

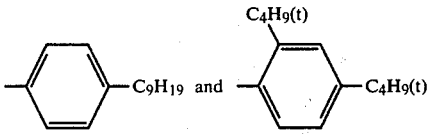

(iv) Alkylaryloxyalkyl groups such as

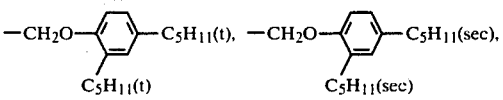

-continued

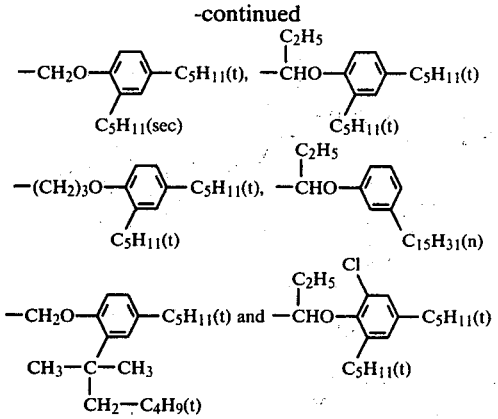

See also British Pat. Nos. 562,205 and 1,149,514 and U.S. Pat. Nos. 2,589,004 and 2,908,573. Examples thereof are;

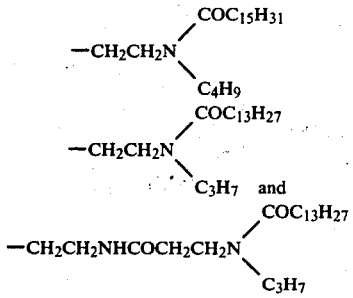

(vi) Alkoxyaryl groups and aryloxyaryl groups such as

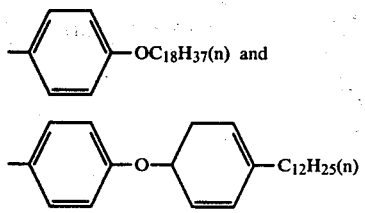

See also Japanese Patent Publication No. 29,414/1968 and British Patent 969,921.

(vii) Residues containing both a long chain aliphatic alkyl or alkenyl group, preferably with 12 to 32 carbon atoms, and a water-solublizing carboxyl or sulfo group such as

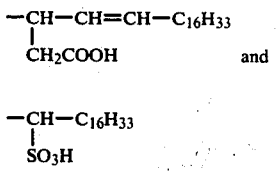

A coupler having a ballast group in the molecule is introduced into a silver halide photographic emulsion by dissolving it in an organic solvent and dispersing the solution in the emulsion as fine particles in accordance with known methods. A specific example of a method of dispersing the coupler into a photographic emulsion particularly suitable for the practice of this invention is explained in detail in the specification of Japanese Patent Application No. 67,797/1969. The organic solvents used for dissolving the coupler include organic solvents which are only slightly soluble in water, have a high boiling point (greater than 170° C.) and which are present together with the coupler in the photographic emulsion layers of a color photographic light-sensitive material are substituted hydrocarbons such as α-dodecyl naphthalene and chlorinated paraffins, carboxylic acid esters, carboxylic acid amides, phosphoric acid esters and ethers. Specific examples of such materials are di-n-butylphthalate, diisooctyl azelate, di-n-butyl sebacate, tricresyl phosphate, tri-n-hexyl phosphate, N,N-diethylcaprylamide, butyl-m-pentadecylphenyl ether and chlorinated paraffins such as chlorocosane. It is preferred to use, in addition to such a high boiling point solvent, up to 10% by weight of the coupler, most preferably no more than 5%, of a subsidiary solvent (which can be removed during the manufacture of the light-sensitive material) to accelerate the dissolution of the coupler in the solvent. Examples of such subsidiary solvents are propylene carbonate, ethyl acetate, butyl acetate, cyclohexanol, tetrahydrofuran, cyclohexanone, etc.

Also, it is preferred to use a surface active agent to finely disperse the oil-soluble coupler in a hydrophilic polymer for the photographic emulsion. In particular, for such a purpose, an anionic surface active agent such as sodium cetylsulfate, sodium p-dodecylbenzenesulfonate, sodium nonylnaphthalenesulfonate, sodium di(2-ethylhexyl)-α-sulfosuccinate, and like surface active agents or a nonionic surface active agent such as sorbitan sesquioleic acid ester, sorbitan monolauric acid ester, etc., is suitable. The surface active agent(s) is usually used in an amount of 0.01–3% by weight, based on the weight of coupler, more preferably 0.02–0.15%. It is also useful for dispersing the oil-soluble coupler to employ a homogenizer for emulsification, a colloid mill, an ultrasonic emulsifying means, etc.

A diffusion resistant or ballasted coupler having a carboxylic acid group or a sulfonic acid group in combination with the ballast group in the molecule is soluble in a neutral or weakly alkaline aqueous solution, i.e., at a hydroxyl ion concentration of $10^{-6}$ to $10^{-1}$ mole/liter equivalent to a pH of 8–13. By adding the aqueous solution of a coupler to a silver halide emulsion, the coupler can be incorporated in the photographic emulsion. It is believed that the coupler becomes diffusion resistant by forming a micelle in a hydrophilic polymer.

A coupler having no such ballast group, that is to say, a coupler of the above type incorporated in a color developer, is used in a color developer together with an aromatic primary amine color developing agent.

Typical examples of compounds among the yellow-forming couplers represented by the general formula I are shown below:

-continued
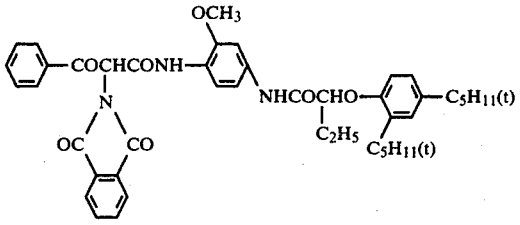
(3)
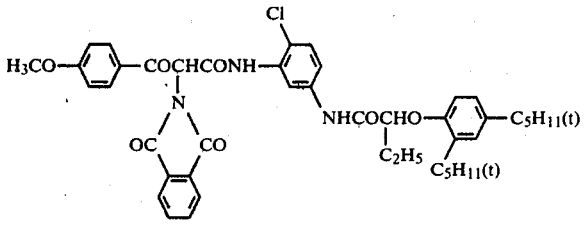
(4)
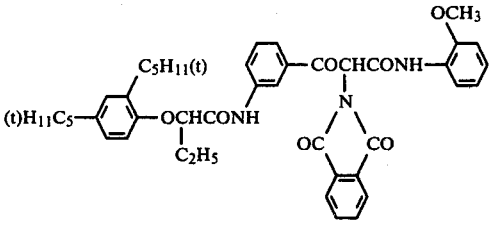
(5)
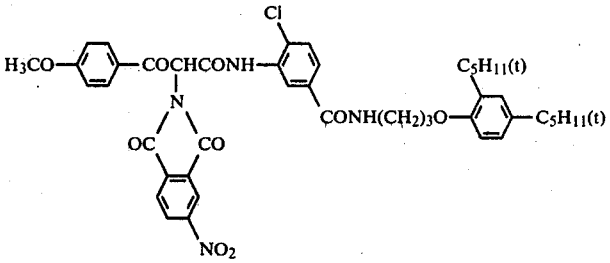
(6)
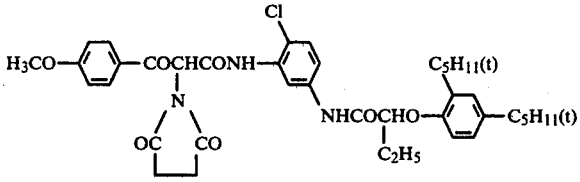
(7)
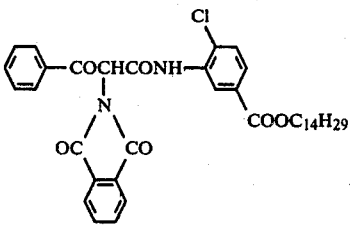
(8)
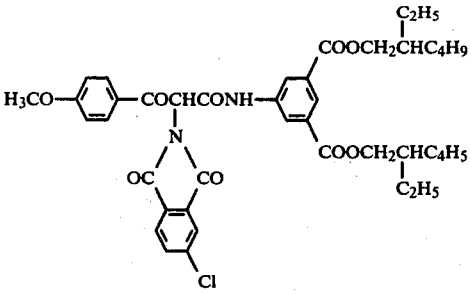
(9)
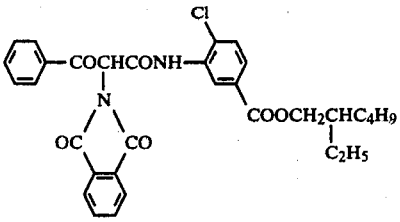
(10)
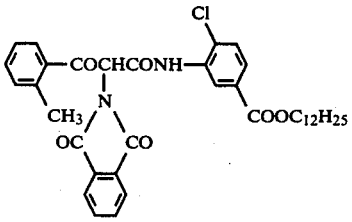
(11)
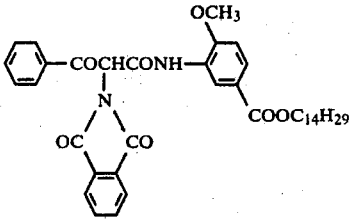
(12)
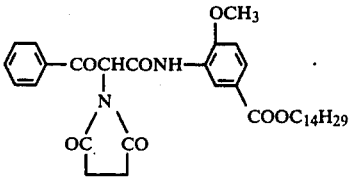
(13)
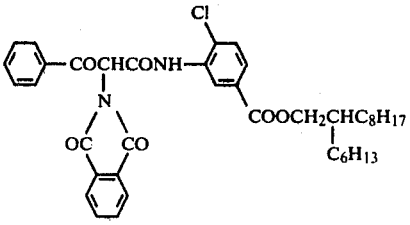
(14)

-continued
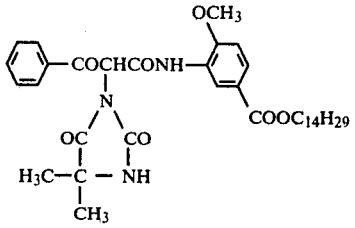
(15)
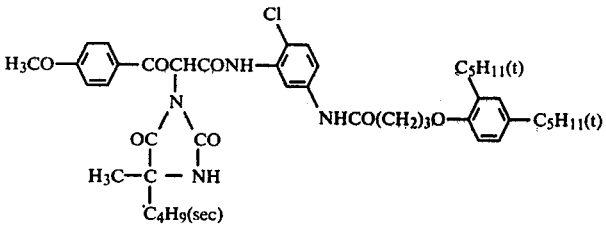
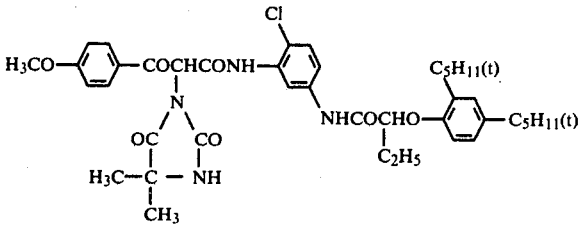
(16)
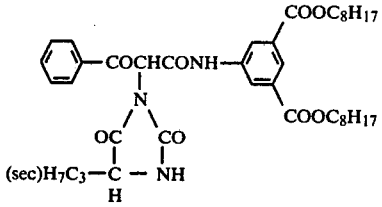
(17)
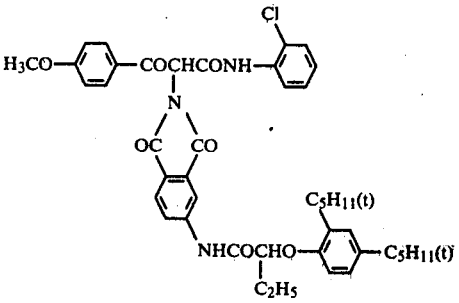
(18)
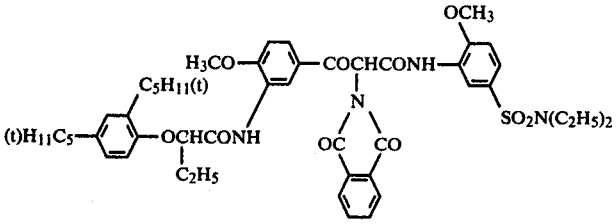
(19)
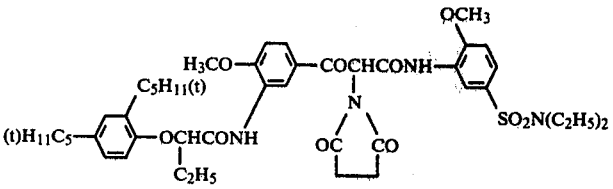
(20)
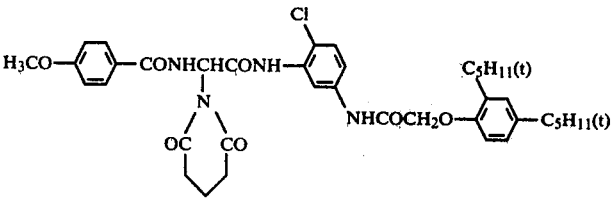
(21)
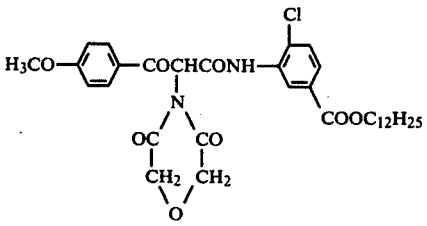
(22)
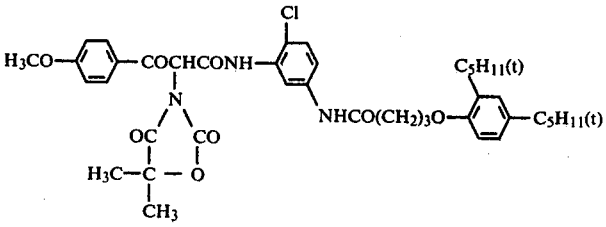
(23)

-continued
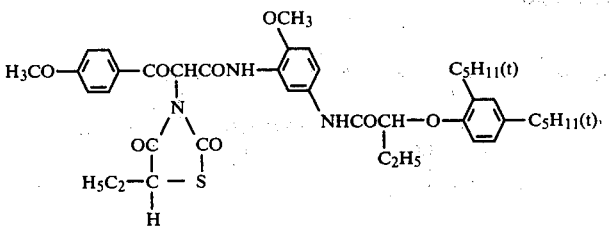
(24)
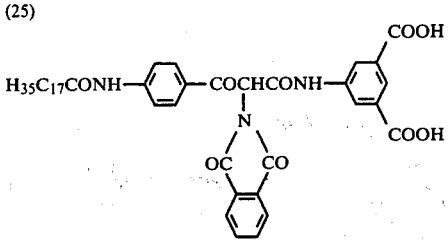
(25)
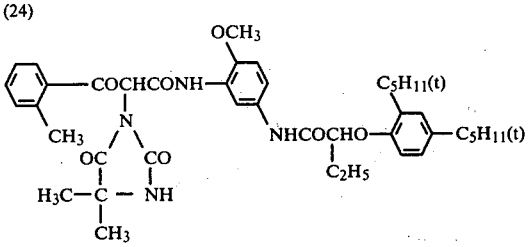
(26)
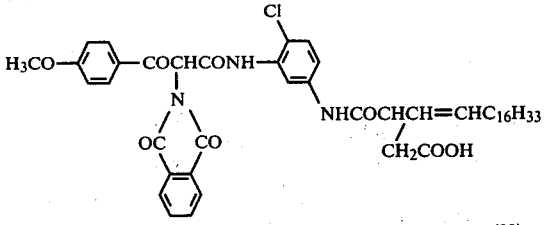
(27)
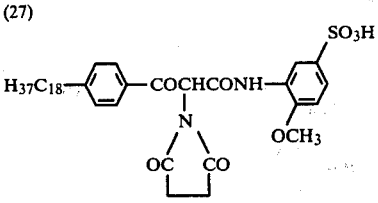
(28)
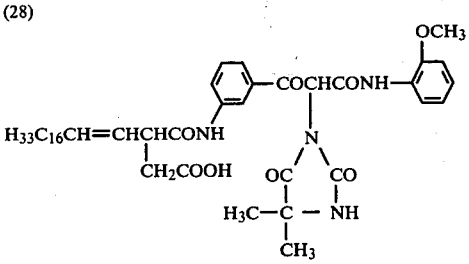
(29)
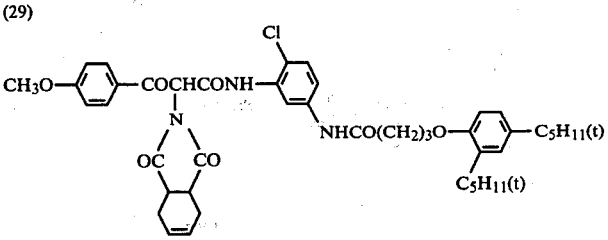
(30)
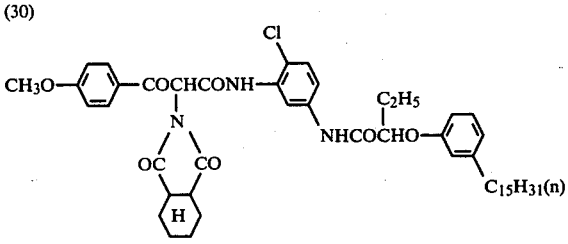
(31)
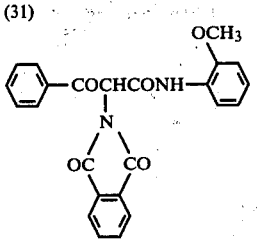
(32)
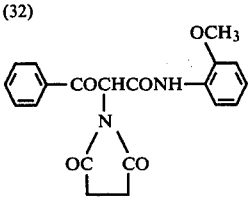
(33)
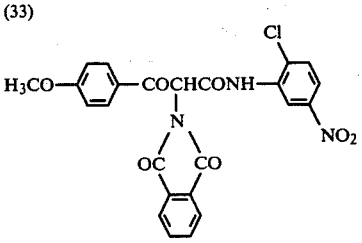
(34)
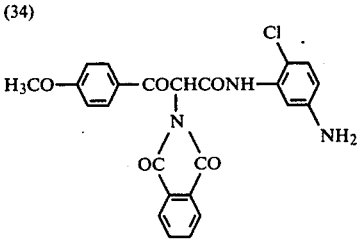
(35)
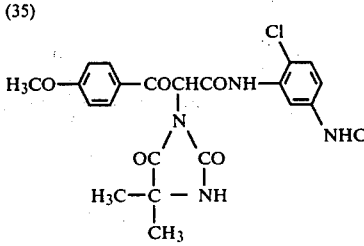
(36)
(37)

-continued
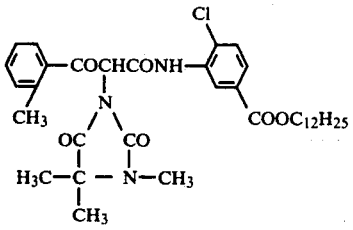
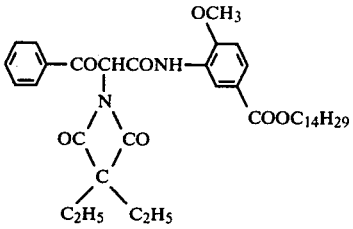
(38)
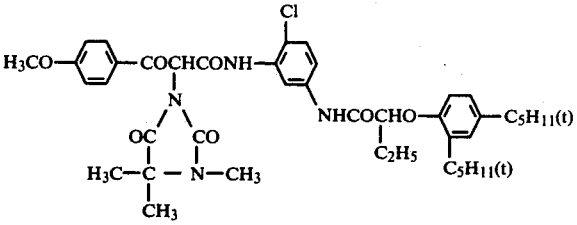
(39)
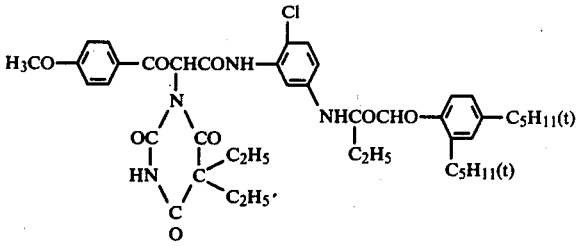
(40)
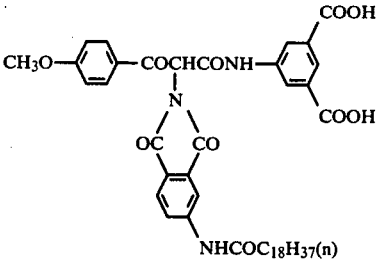
(41)
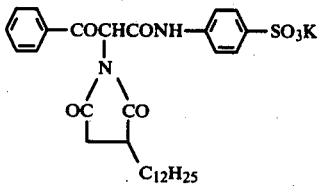
(42)
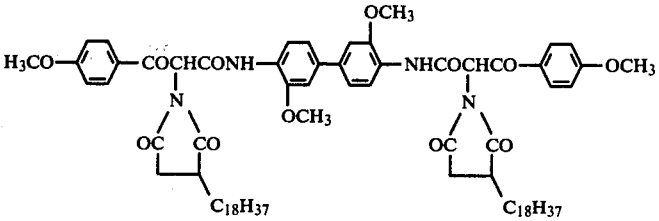
(43)
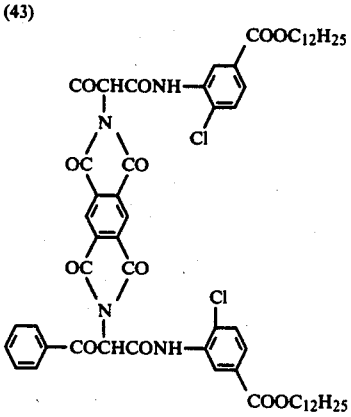
(44)
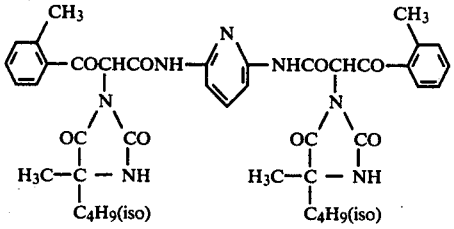
(45)
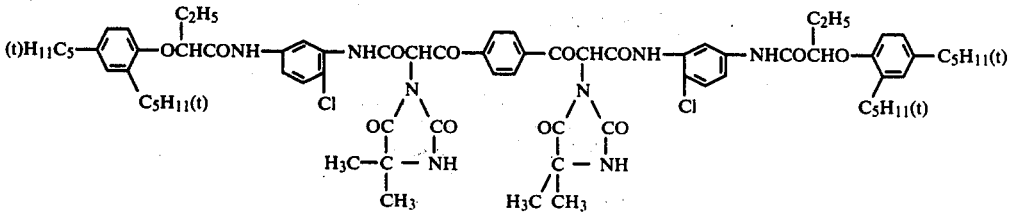

The yellow-forming couplers of this invention can be prepared by reacting a 4-equivalent coupler in which one of the hydrogen atoms of the active methylene group is substituted for with a halogen atom, preferably a bromine atom, and an imide compound. The imide compounds are those which correspond to the

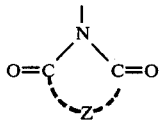

moiety heretofore defined in General Formula I and the free imide or the salt form thereof can be used, in the presence of an inorganic basic material, preferably potassium hydroxide or sodium hydroxide or an organic basic material, preferably, triethylamine or 1,4-diazabicyclo-[2,2]-octane in an organic solvent. In the above reaction, a salt of the corresponding imide compound with an inorganic or organic basic material can also be used in place of the free imide compound. In the latter case, the inorganic or organic basic material used in the above reaction may not be necessary.

The amount of basic material is not overly critical, but best results are obtained when about 1–about 2 moles of basic material are used per one mole of imide compound. Greater and lesser amounts of basic material can be used with success, however.

The solvent which can be used in the reaction includes an amide solvent such as dimethylformamide, dimethylacetamide, hexamethylphosphoramide, etc., having a dielectric constant of more than 30, N-methyl-2-pyrollidone and tetramethylurea and an oxide solvent such as dimethylsulfoxide. The exact amount of solvent used can be varied within a wide range and is not overly critical so long as sufficient solvent is present to permit the reaction to smoothly proceed. Excellent results are obtained using about 5– about 20 weight parts of solvent per 1 weight part of imide, however.

The reaction proceeds at a low temperature and at a high rate to provide the objective coupler of high purity and at high yields using such solvents.

On the other hand, when the synthesis of 2-equivalent couplers is conducted by refluxing with heating and employing acetonitrile as a solvent, as is described in Japen Patent Publication No. 26133/72 and U.S. Pat. No., 3,408,194, to prepare a coupler of this invention, the desired coupler cannot be adequately obtained. This is because side products are formed in great excess and it is very hard to separate and purify the desired product. The main side product is a dimer of the coupler bonded at a coupling position.

The imide compound is desirably used in a molar excess based on the coupler, preferably in a 1.5 to 3 times molar excess.

The reaction can proceed within a broad temperature range, preferably at from 0° C. to 80° C.

The amide solvent and the sulfoxide solvent can be used alone or as mixtures of two or more thereof. In order to control the reaction rate, the solvent can be diluted with commonly employed solvents including alcohols such as methanol, ethanol, and isopropanol; halogenated hydrocarbons such as chloroform and methylchloroform; hydrocarbons such as ligroin and hexane, aromatic hydrocarbons such as benzene, toluene and xylene; acetonitrile and the like.

SYNTHESIS EXAMPLE 1

Synthesis of 2'-chloro-5'-[α-(2,4-di-t-amylphenoxy)-butylamido]-4-methoxy-α-phthalimido-benzoylacetanilide (Coupler 2):

A mixture of 70 g of 2'-chloro-5'-[α-(2,4-di-5-t-amylphenoxy)-butylamido]-4-methoxy-α-bromobenzoylacetanilide and 55.5 g of phthalimide potassium was stirred in 500 ml of dimethylsulfoxide for 4 hours at room temperature. The reaction product was poured in 2 liters of water and extracted with one liter of ethyl acetate. The ethyl acetate layer formed was recovered, washed with a diluted hydrochloric acid solution (5% HCl), washed with water and then dried over Glauber's salt. By distilling ethyl acetate off under reduced pressure (15–30 mm Hg) and recrystallizing the product from a solvent mixture of ethyl acetate and hexane (1:4), 55 g of the Coupler 2 having a melting point of 155°–157° C. was obtained.

SYNTHESIS EXAMPLE 2.

Synthesis of 2'-chloro-5'-tetradecyloxycarbonyl-α-phthalimido-benzoylacetanilide (Coupler 6):

A mixture of 16.3 g of 2'-chloro-5'-tetradecyloxycarbonylchloro-benzoylacetanilide and 18.5 g of phthalimide potassium was stirred in 300 ml of dimethylformamide for 3 hours at room temperature. The reaction product thus obtained was treated as in Synthesis example 1. Upon recrystallizing the product from methanol, 12 g of Coupler 6 having a melting point of 81°–82° C. was obtained.

SYNTHESIS EXAMPLE 3.

Synthesis of 3-[α-(2,4-di-t-amylphenoxy)butylamido]-5'-N,N-diethylsulfamyl-4,2'-dimethoxy-α-phthalimido-benzoylacetanilide (Coupler 18):

A mixture of 16.5 g of 3-[α-(2,4-di-t-amylphenoxy)-butylamido]-5'-N,N-diethylsulfamyl-4,2'-dimethoxy-α-bromo-benzoylacetanilide and 11 g of phthalimide was stirred in 250 ml of dimethylformamide for 3 hours at room temperature. The reaction product was treated as in Synthesis example 1 and the product obtained was recystallized from a solvent mixture of ethanol and ligroin (1:1). Upon recrystallizing the product from acetonitrile, 11.5 g of Coupler 18 having a melting point of 197°–200° C. was obtained.

SYNTHESIS EXAMPLE 4.

Synthesis of 2'-chloro-5'-[α-(2,4-di-t-aminophenoxy)-butylamido]-4-methoxy-α-succinimido-benzoylacetanilide (Coupler 5):

A mixture of 50 g of 2'-chloro-5'-[α-(2,4-di-t-amylphenoxy)butylamido]-4-methoxy-α-bromobenzoylacetanilide and 30 g of succinimide potassium was stirred in 300 ml of dimethylformamide for 3 hours at room temperature. The reaction product was treated as in Synthesis example 1. Upon recrystallizing the product from a mixture of ethyl acetate and hexane (1:4), 36 g of Coupler 5 having a melting point of 138°–139° C. was obtained.

SYNTHESIS EXAMPLE 5.

Synthesis of 2'-chloro-5'-[α-(2,4-di-t-amylphenoxy)-butylamido]-4-methoxy-α-(5,5-dimethyl-3-hydantoinyl)-benzoylacetanilide (Coupler 14):

A mixture of 35 g of 2'-chloro-5'-[α-(2,4-di-t-amylphenoxy)-butylamido-4-methoxy-α-bromo-acetanilide and 25 g of the potassium salt of 5,5-dimethylhydantoin was stirred in 250 ml. of dimethylformamide for 3 hours at room temperature. The reaction product thus obtained was treated as in Synthesis example 1. Upon recrystallizing the product from ethanol, 18 g of the Coupler 14 having a melting point of 122°-125° C. was obtained.

SYNTHESIS EXAMPLE 6.

Synthesis of 2'-chloro-4-methoxy-5-nitro-α-phthalimidobenzoylacetanilide (Coupler 33):

A mixture of 30 g of 2'-chloro-4-methoxy-5-nitro-α-bromo-benzoylacetanilide and 39 g of phthalimide potassium was stirred in 400 ml of dimethylformamide for 3 hours at room temperature. The reaction product was treated as in Synthesis example 1. Upon recrystallizing the product from methyl cellosolve, 14 g of the Coupler 33 having a melting point of 203°-205° C. was obtained.

SYNTHESIS EXAMPLE 7.

Synthesis of 5'-amino-2'-chloro-4-methoxy-α-phthalimidobenzoylacetanilide (Coupler 34):

10 g of 2'-chloro-4-methoxy-5-nitro-α-phthalimidobenzoylacetanilide prepared in Synthesis example 6 was added to 100 ml of 90% acetic acid. The mixture was heated on a steam bath and then 5 g of reduced iron was slowly added to the mixture with stirring. The reaction product was filtered, the filtrate was poured in one liter of water, and the crystals thus formed were recovered by filtration, washed with water and recrystallized from ethanol to provide 4 g of the Coupler 34 having a melting point of 105°-107° C.

SYNTHESIS EXAMPLE 8.

Synthesis of 2'-chloro-5'-α-2,4-di-t-amyl-phenoxy-butylamido-4-methoxy-α-phthalimido-benzoylacetanilide (Coupler 2):

The synthesis example 1 was repeated except for using 400 ml of dimethylacetamide in place of 500 ml of dimethylformamide with stirring for 30 minutes. The reaction mixture was treated as in Synthesis example 1 to obtain 60 g of coupler 2 having a melting point of from 155° to 157° C.

SYNTHESIS EXAMPLE 9.

Synthesis of 2'-chloro-5'γ-2,4-di-t-amylphenoxy-butylamido-4-methoxy-2(5.5-dimethyl-3-hydantoinyl)-benzoylacetanilide (Coupler 22):

32 g of 2'-chloro-5-γ-(2,4-di-t-amylphenoxy)-butylamido-4-methoxy-α-bromoacetanilide was dissolved into 200 ml of hexamethylphosphoramide. To this solution was added a solution having dissolved therein 25 g of 5.5 dimethylhydantoin and 12 g of potassium hydroxide in 30 ml of methanol, and the combined solution stirred for one hour at room temperature. The reaction mixture was processed in a manner similar to Synthesis example 1 except for recrystallizing from acetonitrile to obtain 26 g of coupler 22 having a melting point of from 142° to 143° C.

SYNTHESIS EXAMPLE 10.

Synthesis example 8 was repeated except for using a mixed solvent of 200 ml of dimethylformamide and 100 ml of acetonitrile to obtain 23 g of coupler 22 having a melting point of from 142° to 143° C.

SYNTHESIS EXAMPLE 11.

Synthesis of 2'-chloro-4'-dodecyloxycarbonyl-2-methyl-α-phthal-imido-benzoylacetanilide (Coupler 9):

29 g of 2'-chloro-4'-dodecyloxycarbonyl-2-methyl-α-bromo-benzoylacetanilide, 29 g of phthalimide and 20 g of triethylamine were stirred for 3 hours at room temperature in 200 ml of dimethylformamide. The reaction mixture was processed in a manner similar to Synthesis example 1 except for using ligroin for recrystallization to obtain 20 g of coupler 9 having a melting point of from 100° to 101° C.

Having thus described several Synthesis examples in accordance with the present invention, it is appropriate to turn to a more detailed description of photographic elements as are formed in accordance with the present invention.

The silver halide photographic emulsion used in this invention is a dispersion of any photosensitive silver halide as is used in the art, such as silver chloride, silver bromide, silver chlorobromide, silver iodobromide, or silver chloroiodobromide in a hydrophilic polymer as colloidal grains. The grain size of the silver halide used in the present invention is not critial, and can vary over the range of materials as are currently used in the art. The average grain size is preferably about 0.05-5μ, more preferably 0.1-2μ.

The photographic emulsion can be prepared by various methods, for example, as described in "Chimie Photographique" (2nd. ed. 1957, Paris) by P. Glafkides. Direct-positive emulsions of the internal-image type as described in "The Theory of the Photographic Process" (3rd. ed. 1966, N.Y.) by Mees and James can also be used in the present invention.

Typical examples of hydrophilic polymers which can be used to form the silver halide photographic emulsion are proteins such as gelatin, high molecular weight non-electrolytes such as polyvinyl alcohol, polyvinyl pyrrolidone, polyvinyl acrylamide, etc., high molecular weight amphoteric electrolytes such as the polyacrylamide treated by a Hoffman's decomposition reaction (see A. M. Schiller and T. J. Suen; Ind. Eng. Chem., Vol. 48, p.2132-2137 (1956)) and a copolymer of acrylic acid and N-vinylimidazole. Other useful hydrophilic polymers include polyvinyl acrylamides such as polyacrylamide cellulose derivatives, polyvinyl alcohols or hydrolyzed polyvinyl acetates as described in U.S. Pat. No. 2,286,215, hydrolyzed cellulose esters such as cellulose acetate hydrolyzed to an acetyl content of 19-26% as described in U.S. Pat. No. 2,327,808, water-soluble ethanolamine cellulose acetates as described in U.S. Pat. No. 2,322,085, and polyacrylamides having a combined acrylamide content of 30-60% and a specific viscosity of 0.25-1.5, or an imidized polyacrylamide of like acrylamide content and viscosity as described in U.S. Pat. No. 2,541,474, zein as described in U.S. Pat. No. 2,563,791, vinyl alcohol polymers containing urethane carboxylic acid groups of the type described in U.S. Pat. No. 2,768,154, vinyl alcohol polymers containing cyano-acetyl groups, such as the vinyl-alcohol-vinyl cyano acetate copolymers described in U.S. Pat. No. 2,808,331 and polymeric materials which result from polymerizing a protein or a saturated acylated protein with a monomer having a vinyl group as described in U.S. Pat. No. 2,852,382.

The silver halide photographic emulsion in this invention may further contain various additives which are ordinarily added to conventional silver halide color photographic emulsions, such as sensitizers, stabilizers, hardening agents, surface active agents, and the like.

For example, sensitizers such as (a) speed-increasing compounds such as those described in U.S. Pat. Nos.

2,271,623, 2,288,226, 2,334,864 and 2,708,162 and (b) compounds increasing the light-sensitivity of the silver halide as disclosed in British Pat. No. 1,221,875, German Offenlegenschrift 2,137,559 and Japanese Patent Application Nos. 19,034/70 and 30,023/71; stabilizers such as benzotriazole, 5-nitrobenzimidazole, 1-phenyl-5-mercaptotetrazole and 4-hydroxy-6-methyl-1,3,3*a*,7-tetrazaindene; hardeners such as those described in U.S. Pat. Nos. 3,325,287 and 3,362,827 and Japanese Pat. Nos. 257,564 and 309,487; surface active agents such as those described in U.S. Pat. No. 3,441,413 and British Pat. Nos. 1,164,095 and 1,012,495; and anti-oxidants such as those described in U.S. Pat. Nos. 2,360,290 and 2,403,721.

The above described silver halide photographic emulsion containing the yellow-forming coupler of this invention in one embodiment of this invention may be applied to various photographic supports. Typical examples of such supports are cellulose acetate films, polystyrene films, polyester films, polycarbonate films, papers, papers coated with a polyalkylene such as polyethylene, and glass plates.

The aromatic primary amine developing agent used in this invention includes a compound having primary amino group at the aromatic ring thereof and has the ability to develop exposed silver halide, and also a precursor capable of forming such a compound. In the practice of this invention, o-aminophenol, p-aminophenol, N,N-di-substituted-o-phenylenediamine, and in particular N,N-p-phenylenediamine, are most often used. Specific examples of such primary aromatic amine developing agents are 4-amino-3-dimethylamino-N,N-diethylaniline, 4-amino-3-ethoxy-N,N-diethylaniline, 4-amino-3,5-dimethyl-N,N-diethylaniline, 4-amino-3-methyl-N-ethyl-N-(β-hydroxyethyl)aniline, 4-amino-3-methyl-N,N-diethylaniline, 4-amino-3-methyl-N-ethyl-N-(β-methylsulfonamidoethyl)aniline, 4-amino-3-(β-methylsulfonamidoethyl)-N,N-diethylaniline, 4-amino-N-ethyl-N-(β-hydroxyethyl)aniline, 4-amino-N,N-diethylaniline and 4-amino-N-ethyl-N-ω-sulfobutylaniline. Additional examples of useful materials are set out in Mees-James: "The Theory of the Photographic Process" (3rd. ed. 1966, N.Y.) in Table 134 on pages 294–295, specifically those compounds marked "++" in Table 134. The developing agent concentration is not critical and is usually about 0.5 g–50 g/liter, with from 1 g–20 g/liter being most preferred.

The color developer used in this invention may contain, in addition to the aforesaid developing agent, various additives as are usually used in color developers. For instance, alkali metal sulfites, carbonates, iodides, bromides, benzyl alcohol, etc.

The coupler used in this invention has the feature that one hydrogen atom on the α-position carbon atom of the α-(aromatic acyl)acetamide has been substituted by an N-cyclic carboimide group. That is to say, a nitrogen atom activated by two carbonyl groups is bonded to the α-position carbon atom of the acylacetamide. It is considered that the oxidation product of the aromatic primary amine developing agent reacts with said α-carboimidoacylacetamide compound to split the bond between the imido nitrogen atom and the α-position carbon atom and to form an azomethine dye and an imido ion.

The coupler used in this invention has the following valuable features.

The α-imidoacylacetamide type coupler of this invention is a 2-equivalent coupler, that is, it requires only two equivalents of silver halide as an oxidizing agent to form one molecule of dye. Thus, as compared with a 4-equivalent acylacetamide type coupler which is conventionally widely used, the amount of silver halide required is reduced one half with the use of the couplers of this invention, and thus the proportion of silver halide contained in the silver halide photographic emulsion layers of photographic light-sensitive materials can be reduced. Accordingly, not only can the production cost of the photographic light-sensitive materials be reduced, but in addition light scattering due to silver halide grains in the photographic emulsion layer can be reduced and thus the sharpness of the image formed can be improved. Furthermore, in the case of this invention the thickness of the silver halide emulsion layer containing the coupler can be reduced due to the reduced proportion of silver halide, and thus the time required for development can also be reduced.

The imide type coupler used in this invention has a high coupling reactivity with the oxidation product of the aromatic primary amino developing agent, and thus the oxidation product of the developing agent formed at color development is quickly removed and the development of the silver halide emulsion is promoted. Thus, the formation of the dye image of this invention is conducted in a short period of time. Also, due to the high reactivity of the coupler of this invention, sufficient coupling or coloring is obtained even if the amount of solvent, in particular the non-volatile solvent for dispersing the oil soluble coupler in a silver halide emulsion, is greatly reduced. By reducing the amount of solvent remaining in the silver halide photographic emulsion layers of a light-sensitive material, the mechanical strength of the emulsion layers can be increased.

In the case of employing the acylacetanilide type coupler substituted by an imide group in accordance with the present invention, the dye-forming step is finished in a color developing bath and thus in subsequent processings the use of a bleaching bath containing a strong oxidizing agent such as potassium ferricyanide or potassium bichromate is not necessary, and the developed light-sensitive material can be processed in a blixing bath containing a weak oxidizing agent, such as the ferric chelate complex of ethylenediaminetetraacetic acid, which results in making it possible to shorten the total color development processing time and to reduce the problem of water pollution due to waste processing liquid such as ferricyanide wastes. On the other hand, in the case of using many conventional acylacetamide type couplers wherein the coupling reaction point has not been substituted, the coupling reaction is not finished in the color developing bath, i.e., a considerable portion of the product of the coupling reaction remains in the stage of a colorless leuco form, and to completely color the colorless leuco form a strong oxidizing agent is required.

When the dye image produced from the imide-substituted acylacetamide type coupler used in this invention is preserved under severe conditions for a long period of time it shows a low tendency to fade.

The silver image by-produced in the step of forming the dye image according to the present invention is readily oxidized in the bleaching bath or the blixing bath, and the reduced silver can be completely removed during processing in a short period of time. Accordingly, a sharp, clear yellow dye image without stains due to residual silver can be obtained in accordance with this invention.

The imide-substituted acylacetamide type coupler used in this invention can be produced at high yields by using starting materials as are easily available in the industry.

The amount of the coupler used in this invention is influenced by the kind of photographic light-sensitive material in which it is to be used and the type of the developing process, but a range of from 0.02 to 1.0 mol of coupler per mol of silver halide in the silver halide emulsion is particularly useful and from 0.1 to 0.5 mol of coupler per mol of silver halide is most preferred. If the amount is less than the lower limit, a large amount of silver halide is required to give the coloring extinction coefficient required by the light-sensitive material, which results in increasing the light scattering of the silver halide emulsion layer and reducing the sharpness of the image. That is, an increase in the amount of silver in a silver halide emulsion is accompanied with an increase in the thickness of the emulsion layer and a reduction in the speed of the developing processing of the emulsion layer. On the other hand, if the amount of the coupler is larger than the upper limit, the conversion of the coupler into dye becomes insufficient, thereby reducing the efficiency of utilizing the coupler. Thus, the use of such a large amount of coupler reduces the economic advantages as well as increases the thickness of the silver halide emulsion layer. Thus, outside the addition range of the coupler set out above, the merits of this invention cannot be sufficiently obtained.

In the embodiment where the coupler is in the developer, the coupler should be present in the developing bath at a level of from 0.1 to 10, preferably from 0.5 to 5, g/liter of developer. As described in the foregoing, when amounts outside the range described above are used, the advantages and objects according to the present invention cannot be sufficiently obtained.

The couplers represented by general formula I may be used individually or may be used as combinations thereof. Furthermore, the coupler of general formula I may be used together with other couplers.

The invention will now be further illustrated by the following examples which comprise preferred embodiments of the invention.

EXAMPLE 1

A solution prepared by heating a mixture of 28.8 g of Coupler (2), i.e., α-4'-methoxybenzoyl-α-phthalimido-2-chloro-5-[α-(2'',4''-di-t-amylphenoxy)-butlamido]-acetanilide, 30 ml of di-n-butyl phthalate and 50 ml of cyclohexanone, to 70° C. was added to 300 ml of an aqueous solution containing 30 g of gelatin and 2.0 g of sodium dodecylbenzenesulfonate followed by stirring. Then, the mixture was pre-heated to 45° C. and passed through a colloid mill five times, whereby the coupler was finely dispersed in the solvent.

The total amount of the emulsified dispersion of the coupler was added to 1.0 kg of a photographic emulsion containing 54 g of silver iodobromide (molar ratio I:Br=3:97) and 60 g of gelatin, and after further adding 30 ml of a 3% acetone solution of triethylene phosphamide to the mixture as a hardening agent, the pH of the mixture was adjusted to 6.0. Then, the silver halide emulsion thus prepared was applied to a triacetyl cellulose film in a dry thickness of 7.0 microns to provide a photographic light-sensitive material, which was called Sample A. The coupler content in Sample A was $1.96\times10^{-3}$ mol/m$^2$.

A comparison sample of a photographic light-sensitive material was prepared following the same procedure as in the production of Sample A using 23.5 g of α-4'-methoxybenzoyl-2-chloro-5-[α-(2'',4''-di-t-amylphenoxy)butylamido]-acetanilide (Coupler a) in place of Coupler 2, and the comparison sample was called Sample B.

Each of the photographic light-sensitive materials was subjected to a step exposure for sensitometery under a graduated optical wedge with light of 50 CMS for 1/20'' (see Russell Campbell: "Photographic Theory for the Motion Picture Cameraman" (1st ed., 1970, N.Y.) and then subjected to the following processings;

| | | |
|---|---|---|
| 1. Color development | 20° C. | 15 minutes |
| 2. Water washing | 18° C. | 1 minute |
| 3. First fixing | 20° C. | 4 minutes |
| 4. Water washing | 18° C. | 3 minutes |
| 5. Bleaching | 20° C. | 5 minutes |
| 6. Water washing | 18° C. | 3 minutes |
| 7. Second fixing | 20° C. | 3 minutes |
| 8. Water washing | 18° C. | 15 minutes |

The composition of the color developer used in the above color development was as follows:

| Color developer A | |
|---|---|
| Water | 1000 ml |
| 4-Amino-3-methyl-N,N-diethylaniline hydrochloride | 2.5 g |
| Anhydrous sodium sulfite | 3.0 g |
| Sodium carbonate (mono-hydrate) | 47.0 g |
| Potassium bromide | 2.0 g |

The fixing solution used in the above processing was an acid aqueous solution containing sodium thiosulfate and sodium sulfite and the bleaching solution used above was a neutral solution containing potassium ferricyanide and potassium bromide:

| Fixing solution | |
|---|---|
| Sodium thiosulfate (anhydrous) | 153.0 g |
| Sodium sulfite (anhydrous) | 15.0 g |
| Glacial acetic acid | 13.5 ml |
| Boric acid | 7.5 g |
| Potassium alum | 15.0 g |
| Water to make | 1000 ml |
| pH 4.25 ± 0.25 at 25° C. | |
| Bleaching solution | |
| Potassium ferricyanide | 50.0 g |
| Potassium bromide | 20.0 g |
| Water to make | 1000 ml |
| pH 6.5 ~ 7.0 at 25° C. | |

After processings, the optical density to blue light was measured for Sample A and Sample B, the results of which are shown in Table 1. The color image of both samples was a sharp yellow image with the absorption maximum at 454 millimicrons.

TABLE 1

| Sample | Coupler | Fog | Sensitivity* (relative) | Gamma | Maximum density |
|---|---|---|---|---|---|
| A | (2) | 0.18 | 100 | 2.57 | 3.24 |
| B | (a) | 0.12 | 96 | 1.63 | 2.51 |

*exposure amount required to obtain a density 0.10 above fog.

Then, the "maximum density to blue light" for Sample A and Sample B, obtained when the samples were processed while changing the processing time for the color development, was measured, the results of which are shown in Table 2.

TABLE 2

| Sample | Coupler | Development time (minutes) 5 | 10 | 15 | 20 |
|---|---|---|---|---|---|
| A | (2) | 2.66 | 3.25 | 3.24 | 3.27 |
| B | (a) | 1.69 | 2.32 | 2.51 | 2.53 |

These results show that the imide group-substituted coupler used in the process of this invention could gave higher sensitivity, gradation, and coupling density than unsubstituted coupler (a) used in the comparison sample, and further, in the case of using the coupler of this invention, sufficient color was obtained in a shorter period of time, which reduces the total processing time. This clearly shows that the imide-substituted coupler has a higher coupling reactivity than an unsubstituted one.

To further clarify the improved coupling reactivity of the coupler of this invention, the following experiment was conducted.

A silver bromide emulsion layer containing a mixture of (2) or (a) and a cyan-forming coupler (b), 4,6-dichloro-5-methyl-2-[α-(2',4'-di-tert-amylphenoxy)-acetamido] phenol was developed in color developer A at 21° C. for 14 mins, where the two couplers react competitively with the oxidized developing agent to give a mixture of yellow and cyan dyes. Then, by analyzing the formation ratio of the yellow dye to cyan dye, the relative value of the reaction rate constant of the coupling reaction for the yellow-forming coupler based on the cyan-forming coupler (b) was obtained.

The coupling reactivity of a coupler is determined as a relative value by color developing a silver halide emulsion containing two kinds of couplers A and B which give different colors which can be clearly separated from each other, and measuring the amount of each dye in the dye image thus formed. If coupler A shows a color density $D_A$, the max. value of which is $(D_A)$ max., and coupler B shows a color density $D_B$, the max. value of which is $(D_B)$ max., respectively, the ratio $R_A/R_B$ of the reactivities of the both couplers is shown by the following equation:

$$\frac{\log(1 - \frac{D_A}{(D_B)_{max}})}{\log(1 - \frac{D_B}{(D_B)_{max}})} = \frac{R_A}{R_B}$$

That is to say, the coupling reactivity ratio $R_A/R_B$ is obtained from the gradient of the line log $(1-D_A/(D_A)_{max.})$ vs. log $(1-D_B/(D_B)_{max.})$.

As a result, the relative rate constant of the imide-substituted coupler (2) of this invention was 6.6, while that of the conventional unsubstituted coupler (a) was 1.1. The results show that the coupling reactivity of the imide type coupler used in this invention was 6 times higher than that of the conventionally known unsubstituted coupler.

EXAMPLE 2

Sample A and Sample B prepared in Example 1 were subjected to step exposure for sensitometry under a graduated optical wedge light of 100 CMS for 1/20" and processed as follows;

| | | |
|---|---|---|
| 1. Color development | 24° C. | 8 minutes |
| 2. Stopping | 24° C. | 2 minutes |
| 3. Blixing | 24° C. | 6 minutes |
| 4. Water washing | 24° C. | 5 minutes |

The color developer used in the above color development processings was the same as in Example 1, and the compositions of the other processing solutions were as follows:

| | |
|---|---|
| Stopping solution | |
| Water | 1000 ml |
| Anhydrous sodium sulfite | 5.0 g |
| Glacial acetic acid | 15.0 ml. |
| Blixing solution | |
| Water | 1000 ml |
| Ammonium thiosulfate | 105.0 g |
| Sodium sulfite | 80 g |
| E. D. T. A. (disodium salt) | 35.0 g |
| Ferric chloride (hexahydrate) | 25.0 g |
| Potassium thiocyanate | 10.0 g |

After processing, the optical density to blue light was measured for each sample. Then, each sample was immersed in a 1.5% aqueous solution of potassium ferricyanide for 2 minutes at 24° C., washed with water for 10 minutes, and dried. Thereafter, the optical density to blue light was measured again, the results of which are shown in Table 3.

TABLE 3

| Sample | Coupler | Post treatment by ferricyanide solution: Before (i) | Before (ii) | Before (iii) | After (i) | After (ii) | After (iii) |
|---|---|---|---|---|---|---|---|
| A | (2) | 0.19 | 2.52 | 3.28 | 0.19 | 2.53 | 3.30 |
| B | (a) | 0.12 | 1.24 | 1.96 | 0.13 | 1.61 | 2.55 |

(i): fog;
(ii): gamma;
(iii): maximum density.

As is shown in Table 3, it is clear that in case of using the imide-substituted coupler (2) of this invention the formation of the color image was finished in the steps of color development and blixing, while in case of using conventional unsubstituted coupler (a), the formation of the color image in those steps was only about ¾ completed and the remaining reaction product was in a colorless state. In order to completely convert the colorless reaction product into dye, processing with a strong oxidizing agent was required. Thus, the results show that using the novel imide-substituted yellow-forming coupler of this invention, the number of color development processings can be reduced.

EXAMPLE 3

A mixture of 63.7 g of Coupler (19), α-{4'-methoxy-3'-[2-(2'',4''-di-t-amylphenoxy)butylamido]}benzoyl-α-succinimido-2-methoxy-5-(N,N-diethylsulfamoyl)-acetanilide, 65 ml of tri-n-hexyl phosphate, 100 ml of ethyl acetate, and 3.2 g of sodium dinonylnaphthalenesulfonate was heated on a steam bath to prepare a solution. After adding the solution to 700 ml of an aqueous solution of 50 g of gelatin, the mixture was stirred and then further stirred vigorously in a high speed agitator whereby the coupler was finely dispersed in the solvent.

The total amount of the thus obtained emulsified dispersion was added to 1.5 kg of a photographic emulsion containing 0.30 mol of silver chlorobromide (molar ratio of Cl:Br=30:70) and 100 g of gelatin, and after adding further 15 ml of a 4% aqueous solution of 1-hydroxy-3,5-dichloro-S-triazine as a hardening agent and adjusting the pH of the mixture to 6.5, the mixture was applied to a baryta-coated paper (which was coated on both surfaces with polyethylene) to a dry thickness of 3.0 microns to provide a photographic light-sensitive material, which was designated Sample C. The content of the coupler in Sample C was $1.03\times10^{-3}$ mol/m$^2$.

For the sake of comparison, an emulsified dispersion of a comparison coupler was prepared following the same procedure as was used in preparing Sample C using 56.4 g of α-{4'-methoxy-3'-[α-(2'',4''-di-t-amylphenoxy)butylamino]}-benzoyl-2-methoxy-5-(N,N-diethylsulfamoyl)-acetanilide (Coupler C) in place of the Coupler (19).

The total amount of the emulsified dispersion thus prepared was added to 3.0 kg of a photographic emulsion containing 0.60 mol of silver chlorobromide and 200 g of gelatin, and after adding to the dispersion 25 ml of a 4% aqueous solution of the sodium salt of 1-hydroxy-3,5-dichloro-S-triazine and adjusting the pH of the mixture to 6.5, the mixture was applied to a baryta-coated paper as was used to form Sample C in a dry thickness of 4.0 microns to provide a photographic light-sensitive material, which was designated Sample D. The content of the coupler in Sample D was $1.01\times10^{-3}$ mol/m$^2$.

The silver halide emulsions used for preparing these samples were prepared by dividing the same silver chlorobromide emulsion into two portions and diluting each part with an aqueous gelatin solution, if necessary. The content of coupler was the same in each emulsion but the content of silver was different.

Each of the samples was subjected to a stepwise exposure for sensitometry as in Example 2 and then processed as in Example 1 except that the same was developed in a developer B having the following composition for 12 minutes at 24° C.

| Color developer B | |
|---|---|
| Water | 1000 ml |
| Benzyl alcohol | 12.0 g |
| Sodium hexametaphosphate | 2.0 g |
| Anhydrous sodium sulfite | 2.0 g |
| Sodium carbonate (monohydrate) | 27.5 g |
| Hydroxylamine sulfate | 2.5 g |
| 4-Amino-3-methyl-N-ethyl-N-(β-methanesulfoneamidoethyl)-aniline sesquisulfate (monohydrate) | 4.0 g |

After processing, the reflection optical density of each sample thus processed to blue light was measured, the results of which are shown in Table 4.

TABLE 4

| Sample | Coupler | AgX/coupler mol ratio | Fog | Sensitivity (relative) | Gamma | Maximum density |
|---|---|---|---|---|---|---|
| C | (19) | 4 | 0.15 | 100 | 2.06 | 1.63 |
| D | (C) | 8 | 0.10 | 87 | 1.28 | 1.47 |

From Table 4, it is clear that coupler (19) of this invention showed a higher degree of coloring than unsubstituted coupler (C) having a corresponding structure, even in the case of using less silver halide, whereby the thickness of the emulsion layer could be reduced.

EXAMPLE 4

A solution prepared by heating a mixture of $5\times10^{-3}$ mol of each carbonimide group-substituted coupler mentioned above, 4.5 ml of di-n-butyl phthalate, 8 ml of cyclohexanone, and 0.2 g of bis(2-ethylhexyl)-α-sulfosuccinate (sodium salt) on a hot plate was added to 60 ml of an aqueous solution containing 5 g of gelatin and the mixture was stirred vigorously in a homoblender to finely disperse the coupler.

The total amount of the coupler dispersion thus obtained was added to 150 g of a fine grain silver halide emulsion containing 3.8 g of silver bromide and 13 g of gelatin and the mixture was applied to a cellulose triacetate film in a dry thickness of 7 microns to provide a photographic light-sensitive film.

By exposing each of the photographic light-sensitive films and developing it as in Example 1, a yellow image was obtained. The spectral absorption characteristics of each yellow dye image was measured by means of a spectrophotometer and the absorption maximum values as are shown in the following table were obtained.

TABLE 5

| Coupler | Absorption maximum (μ) | Coupler | Absorption maximum (μ) |
|---|---|---|---|
| (1) | 446 | (15) | 455 |
| (2) | 454 | (16) | 454 |
| (3) | 447 | (17) | 453 |
| (4) | 454 | (18) | 453 |
| (5) | 455 | (19) | 453 |
| (6) | 457 | (20) | 455 |
| (7) | 451 | (21) | 450 |
| (8) | 456 | (22) | 454 |
| (9) | 455 | (23) | 446 |
| (10) | 448 | (24) | 448 |
| (11) | 449 | (26) | 455 |
| (12) | 457 | (28) | 450 |
| (13) | 448 | (29) | 454 |
| (14) | 454 | (30) | 454 |

As is clear from the results shown in Table 5, the couplers of this invention have absorption maximums in the range of 440–460 microns, and thus have spectral absorption characteristics suitable for color reproduction by a subtractive color process.

EXAMPLE 5

A solution prepared by heating a mixture of 26.5 g of Coupler (13) α-benzoyl-α(5',5'-dimethyl-3'-hydantoinyl)-2-methoxy-t-tetradecylcarboxyacetanilide, 25 ml of di-n-butyl phthalate, and 55 ml of ethyl acetate to 60° C. was added with stirring to 400 ml of an aqueous solution containing 5.0 g of sodium di-(2-ethylhexyl)-α-sulfosuccinate and 36 g of gelatin and the emulsion obtained was passed twice through a milk homogenizer, whereby the coupler was finely emulsified in the solvent.

The total amount of the emulsified dispersion thus prepared was added to 700 g of a photographic emulsion containing 22.6 g of silver iodide (2 mol% iodide) and 50 g of gelatin, and after adding to the mixture 20 ml of a 3% acetone solution of triethylene phosphamide as a hardening agent and adjusting the pH of the mixture to 6.5, the mixture was applied to a baryta-coated paper (having on both surfaces polyethylene layers) in a dry thickness of 3.5 microns.

A gelatin solution was further applied to the silver halide emulsion layer thus formed in a dry thickness of 1.0 micron as a second layer and further a green-sensitive silver halide emulsion containing a magenta-forming coupler (d) having the following formula was applied thereto in a dry thickness of 3.5 microns:

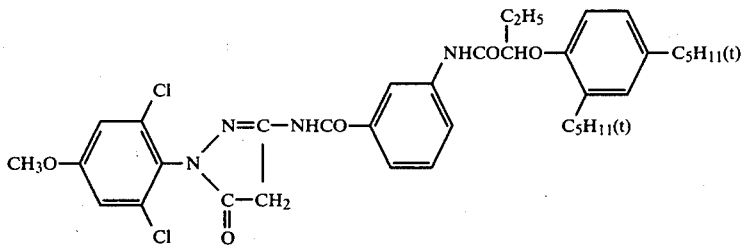

A gelatin solution containing 2-(2'-benzotriazolyl)-4,6-dibutylphenol sufficient to provide a coating concentration of 1.2 g/m$^2$ was applied to the green-sensitive emulsion layer in a thickness of 2.5 microns as a fourth layer. Then, a red-sensitive silver halide emulsion layer containing cyan-forming coupler(e) having the following formula was applied thereto as a fifth layer in a dry thickness of 4.0 microns:

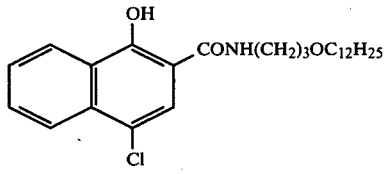

Finally, a gelatin solution was applied to the red-sensitive emulsion layer in a dry thickness of 0.5 micron as the uppermost layer to provide a color photographic paper.

The green- and red-sensitive emulsion layers had the following concentrations of components, respectively:

| | | | | |
|---|---|---|---|---|
| Green-sensitive | Components | Ag Br—Cl 50:50 mole | Coupler | Gelatin |
| | Coverage | $9.0 \times 10^{-3}$ mole/m$^2$ | $9.0 \times 10^{-4}$ mole/m$^2$ | 3.1 g/m$^2$ |
| Red-sensitive | Components | Ag Br—Cl 50:50 mole | Coupler | Gelatin |
| | Coverage | $5.5 \times 10^{-3}$ mole/m$^2$ | $1.1 \times 10^{-3}$ mole/m$^2$ | 3.6 g/m$^2$ |

A color negative was optically printed on the color photographic paper prepared as above and the color paper was processed in the color developer B and in the blixing solution as in Example 2. The color print thus obtained showed an excellent color reproducing faculty providing a clear color. The yellow dye image had the absorption maximum at 443 millimicrons.

EXAMPLE 6

A solution prepared by heating a mixture of 24.2 g of Coupler (9), i.e., 2'-chloro-5'-dodecyloxycarbonyl-2-methylbenzoylacetanilide, 50 ml of ethyl acetate and 25 ml of di-n-butyl phthalate to 50° C. was added to 250 ml of an aqueous solution containing 25 g of gelatin and 1.25 g of sodium dodecylbenzenesulfonate followed by vigorous stirring by means of a homoblender to finely disperse the coupler.

The total amount of the emulsified dispersion of the coupler was added to 500 g of a photographic emulsion containing 28 g of silver bromide and 35 g of gelatin and, after further adding 15 ml of a 2% aqueous solution of 1-hydroxy-3,5-dichloro-S-triazine sodium salt to the mixture as a hardening agent, the pH of the mixture was adjusted to 6.5. Then, the silver halide emulsion thus prepared was applied to a triacetyl cellulose film in a dry thickness of 5.0μ to provide a photographic light-sensitive material, which was called Sample E. The coupler content and the silver amount in Sample E were $1.74 \times 10^{-3}$ mol/m$^2$ and 0.76 g/m$^2$, respectively.

In order to prepare a comparison sample, a solution prepared by heating a mixture of 18.8 g of 2'-chloro-5'-dodecyloxycarbonyl-2-methylbenzoylacetanilide (coupler b, illustrated below) in place of Coupler (9), 35 ml of ethyl acetate and 20 ml of di-n-butyl phthalate to 50° C. was added to 200 ml of an aqueous solution containing 20 g of gelatin and 1.0 g of sodium dodecylbenzenesulfonate followed by vigorous stirring by means of a homo-blender as above to finely disperse the coupler.

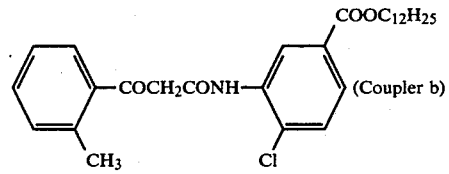

The total amount of the emulsified dispersion of Coupler b was added to 1 kg of the same silver bromide emulsion as above and, after further adding 20 ml of the same solution of the hardening agent as above, the pH was adjusted to 6.5. Then, the silver halide emulsion thus prepared was applied to a triacetyl cellulose base in a dry thickness of 6.0μ to provide a photographic light-sensitive material, which was called Sample F. The coupler content and the silver amount in Sample F were $1.77 \times 10^{-3}$ mol/m$^2$ and 1.54 g/m$^2$, respectively.

Each of the photographic light-sensitive materials was subjected to a step exposure for sensitometry and then processed as described in Example 1.

After the processings, the optical density to blue light was measured for Sample E and Sample F, the results of which are shown in Table 6.

TABLE 6

| | | Capability of color formation | | | | |
|---|---|---|---|---|---|---|
| Sample | Coupler | Molecular ratio of AgX/Coupler | Fog | Sensitivity (relative to Sample E = 100) | γ | Maximum density |
| E | (9) | 4/1 | 0.25 | 100 | 2.56 | 3.04 |

TABLE 6-continued

| Sample | Coupler | Capability of color formation: Molecular ratio of AgX/Coupler | Fog | Sensitivity (relative to Sample E = 100) | γ | Maximum density |
|---|---|---|---|---|---|---|
| F | (b) | 8/1 | 0.22 | 98 | 2.17 | 2.93 |

Then, the maximum density for Sample E and Sample F to blue light obtained when the samples were processed while changing the processing time for the color development as given in Example 1 was measured, the results of which are shown in Table 7.

TABLE 7

| Sample | Coupler | Change in capability of color formation with development time: Molar ratio of AgX/Coupler | Development time (minutes) 5 | 10 | 15 | 20 |
|---|---|---|---|---|---|---|
| E | (9) | 4/1 | 2.80 | 3.03 | 3.04 | 3.00 |
| F | (b) | 8/1 | 2.41 | 2.82 | 2.93 | 2.98 |

These results show that the imide group-substituted Coupler (9) used in the process of the invention could give high sensitivity, gradation and coupling density though the silver amount had been reduced to ½ of that of the unsubstituted Coupler (b), and further that sufficient color was obtained in a shorter period of time, which reduces the total processing time.

To study the equivalence property so as to clarify the fact that the silver amount necessary to form 1 mol of dye from improved Coupler (9) showing a good color-forming property is ½ of the amount necessary in unsubstituted Coupler (b) having a corresponding structure, the following experiment was conducted.

Each of Sample E and Sample F was subjected to a step exposure, then subjected to the processings up to processing step 4 described in Example 1. Then, the amount of silver deposited in the samples containing the color-forming dye and the silver deposit was determined by means of a fluorescent X-ray Quantometer.

The samples were then subjected to processing steps 5–8 as described in Example 1. Thereafter, the formed dye was extracted from the thus processed samples with a mixed solvent of N,N-dimethylformamide and water (85:15 by volume) and analyzed. The results thus obtained are shown in FIG. 1.

In FIG. 1, the molar ratio of amount of silver deposited vs. amount of colored dye in the case of the unsubstituted Coupler (b) is shown to be 5.5–6.0, whereas that in the case of Coupler (9) in accordance with the invention is shown to be 2.5–2.8, which clearly shows that the molar ratio with the coupler in accordance with the present invention is less than ½ of that as achieved with the unsubstituted 4-equivalent coupler.

EXAMPLE 7

A solution prepared by heating a mixture of 56.0 g of Coupler (14), i.e., 5'-[α-(2,4-di-tert-amylphenoxy)-butyl-amido]-2'-chloro-4-methoxy-α-(5,5-dimethyl-3-hydantoinyl)-benzoylacetanilide, 100 ml of ethyl acetate and 50 ml of di-n-butyl phthalate, to 50° C. was added to 500 ml of an aqueous solution containing 50 g of gelatin and 2.5 g of sodium dodecylbenzenesulfonate followed by stirring. Then, the mixture was passed through a pre-heated colloid mill five times, whereby the coupler was finely dispersed in the solvent.

The total amount of the emulsified dispersion of the coupler was added to 1 kg of a photographic emulsion containing 56 g of silver bromide and 70 g of gelatin and, after further adding 30 ml of a 2% aqueous solution of 1-hydroxy-3,5-dichloro-S-triazine sodium salt as a hardening agent, the pH of the mixture was adjusted to 6.5. Then, the silver halide emulsion thus prepared was applied to a triacetyl cellulose film in a dry thickness of 5.0μ to provide a photographic light-sensitive material, which was called Sample G. The coupler content and the silver amount in Sample G were $1.70\times10^{-3}$ mol/m$^2$ and 0.75 g/m$^2$, respectively.

A comparison sample of a photographic light-sensitive material was prepared following the same procedure as in the production of Sample G using 61.5 g of Coupler (c), i.e., 5'-[α-(2,4-di-tert-amylphenoxy)butyl-amido]-2'-chloro-4-methoxy-α-benzosulfimido-benzoylacetanilide, a compound containing an coupling off group represented by the formula

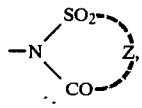

which is analogous to that of the present invention and described in West German Pat. OLS No. 2,057,941, in place of Coupler (14). The resulting comparison sample was called Sample H.

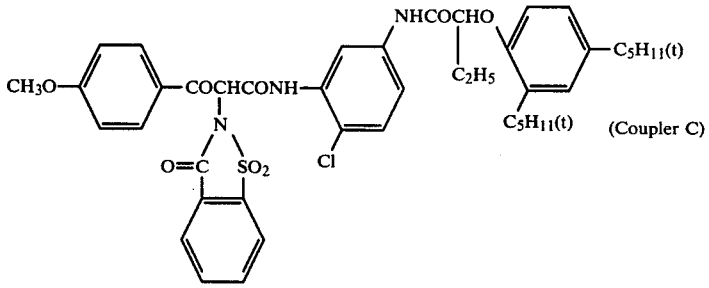

(Coupler C)

The coupler content and the silver amount in Sample H were $1.73\times10^{-3}$ mol/m$^2$ and 0.77 g/m$^2$, respectively.

In order to prepare another photographic light-sensitive material comparison sample, an emulsified dispersion was prepared following the same procedure as in the production of Sample G using 46.6 g of Coupler (a), i.e., 5'-[α-(2,4-di-tert-amylphenoxy)butyl-amido]-2'-chloro-4-methoxy-benzoylacetanilide, which was illustrated in Example 1. The total amount of the emulsified dispersion was added to 2 kg of the same emulsion as was used in the production of Sample G, and after adding 40 ml of the hardener, the resulting coating solution was coated in a dry thickness of 6.0μ to provide a photographic light-sensitive material, which was called Sample I.

The coupler content and the silver amount in Sample I were $1.77\times10^{-3}$ mol/m$^2$ and 1.59 g/m$^2$, respectively.

Each of the thus prepared samples was subjected to a step exposure for sensitometry and then subjected to the same processings as described in Example 3.

After processing, the optical density to blue light was measured for these samples, the results of which are shown in Table 8.

TABLE 8

| | | Capability of color formation | | | | |
|---|---|---|---|---|---|---|
| Sample | Coupler | Molecular ratio of AgX/Coupler | Fog | Sensitivity (relative) | γ | Maximum density |
| G | (14) | 4/1 | 0.05 | 100 | 2.30 | 2.87 |
| H | (c) | 4/1 | 0.06 | 99 | 1.86 | 2.61 |
| I | (a) | 8/1 | 0.03 | 96 | 1.79 | 2.49 |

Furthermore, samples obtained by processing the same samples in the same manner as above were exposed to a 1.5 W xenon arc lamp (150,000 lx) for 80 hours while placing in front of the samples a UV filter interrupting light of wave-lengths shorter than 400 mμ to compare the light-fastness of the formed color images. The results obtained are shown in Table 9.

TABLE 9

| | | Light-fastness of colored images. | | |
|---|---|---|---|---|
| | | Initial density before exposure | | |
| Sample | Coupler | 0.5 | 1.0 | 2.0 |
| G | (14) | 28 | 25 | 20 |
| H | (c) | 76 | 69 | 61 |
| I | (a) | 44 | 41 | 34 |

The numerical values in Table 9 show the percentages of the reduction in the density to blue light based on the initial density to blue light.

In addition, with similarly processed samples the formed images were stored for 20 days under conditions of constant temperature (60° C.) and constant humidity (70% RH), and then the fastness was compared. The results obtained are shown in Table 10.

TABLE 10

| | | Fastness of formed images under high humidity and high temperature | | |
|---|---|---|---|---|
| | | Initial density | | |
| Sample | Coupler | 0.5 | 1.0 | 2.0 |
| G | (14) | 5 | 3 | 3 |
| H | (c) | 48 | 45 | 37 |
| I | (a) | 5 | 5 | 5 |

The numerical values in Table 10 show the percentages of the reduction in the density to blue light based on the initial density to blue light.

From the results set forth in Tables 8, 9 and 10, it is clear that Coupler (14) used in the present invention exhibited greater color density as compared with that in the unsubstituted Coupler (a) having a corresponding structure and Coupler (c) having an analogous coupling-off group represented by the formula

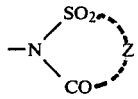

described in West German Pat. OLS No. 2,057,941 and, in addition, that the coupling-off group exerted a great influence on the fastness of the formed image to light and heat-humidity, whereby Couple (14) of the present invention showed excellent fastness.

Furthermore, in order to study the equivalence property, each of Samples G, H and I was processed in the same manner as described in Example 7. Then, the amount of silver deposited and the amount of colored dye were determined. The results thus obtained are shown in FIG. 2.

In FIG. 2, the molar ratios of amount of silver deposited vs amount of colored dye in the case of unsubstituted Coupler (a) and in the case of Coupler (c) having an analogous coupling-off group represented by the formula

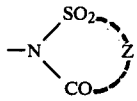

described in West German Pat. OLS No. 2,057,941 are 6.0–6.5 and 2.8–3.3, respectively, whereas that in the case of Coupler (14) in accordance with the invention is 2.2–2.5, which clearly shows that the molar ratio (i.e., equivalence property) of the coupler of the present invention is less than ½ that of the unsubstituted 4-equivalent coupler (a) and less than in the case of Coupler (c).

While the invention has been described in detail and with reference to specific embodiments thereof, it will be apparent to one skilled in the art that various changes and modifications can be made therein without departing from the spirit and scope thereof.

What is claimed is:

1. A method for forming dye images comprising exposing and processing a silver halide photographic emulsion with an aromatic primary amino developing agent in the presence of a yellow dye-forming coupler represented by the following formula:

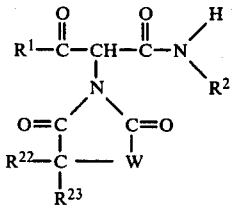

wherein $R^1$ represents an aryl group; $R^2$ represents an aryl group or a heterocyclic group; W represents an oxygen atom or a sulfur atom; and $R^{22}$ and $R^{23}$, which may be the same or different, each represents a hydrogen atom, a halogen atom, an alkyl group, an alkoxy group, an aryl group, an aryloxy group, a sulfo group or a carboxyl group.

2. The method of claim 1, wherein

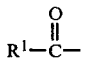

represents an α-benzoyl group; $R^2$ represents an aryl group; W represents an oxygen atom; and $R^{22}$ and $R^{23}$, which may be the same or different, each represents a hydrogen atom, an alkyl group or an aryl group.

3. The method of claim 1, wherein

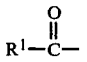

represents an α-benzoyl group; $R^2$ represents an aryl group; W represents a sulfur atom; and $R^{22}$ and $R^{23}$, which may be the same or different, each represents a hydrogen atom, an alkyl group or an aryl group.

4. The method of claim 1, wherein W represents an oxygen atom and $R^{22}$ and $R^{23}$ each represents a methyl group.

5. The method of claim 1, wherein W represents a sulfur atom and $R^{22}$ and $R^{23}$ each represents a methyl group.

6. The method of clam 1, wherein $R^1$ represents (1) a phenyl group; (2) a substituted phenyl group, wherein said substituents are one or more members from the group consisting of halogen atoms, alkyl groups, alkenyl groups, alkoxy groups, aryl groups, aryloxy groups, alkylcarbonyl groups, arylcarbonyl groups, alkylsulfonyl groups, arylsulfonyl groups, carboxyl groups, thiocyano groups, alkoxycarbonyl groups, carbamyl groups, sulfo groups, sulfamyl groups, acylamino groups, ureido groups, sulfonamido groups, amino groups, nitro groups, cyano groups, hydroxyl groups, acyl groups, aryloxycarbonyl groups, alkoxysulfonyl groups, aryloxysulfonyl groups and sulfonamino groups; or (3) a condensed aromatic ring having the formula

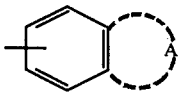

wherein A represents the atoms necessary to form an aromatic condensed ring system; and $R^2$ represents (1) a phenyl group; (2) a substituted phenyl group, wherein said substituents are one or more members from the group consisting of halogen atoms, alkyl groups, alkenyl groups, alkoxy groups, aryl groups, aryloxy groups, arylcarbonyl groups, alkylcarbonyl groups, alkylsulfonyl groups, arylsulfonyl groups, carboxyl groups, thiocyano groups, alkoxycarbonyl groups, carbamyl groups, sulfo groups, sulfamyl groups, acylamino groups, ureido groups, sulfonamido groups, amino groups, nitro groups, cyano groups, hydroxyl groups, acyl groups, aryloxycarbonyl groups, alkoxysulfonyl groups, aryloxysulfonyl groups and sulfonamino groups; (3) a heterocyclic group bound to said

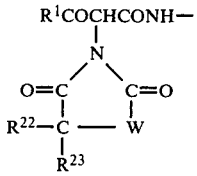

group in the general formula through a carbon atom in said heterocyclic group which is part of the conjugated electron system and selected from the group consisting of the thiophenes, furans, pyrans, chromenes, pyrroles, pyrazoles, pyridines, pyrazines, pyrimidines, pyridazines, indolidines, perimidines, thiazoles, imidazoles, oxazoles, 1,3,5-triazines and the oxazines; and the substituted derivatives thereof, said substituents being selected from the group consisting of halogen atoms, alkyl groups, alkenyl groups, alkoxy groups, aryl groups, aryloxy groups, alkylcarbonyl groups, arylcarbonyl groups, alkylsulfonyl grups, arylsulfonyl groups, carboxyl groups, alkoxycarbonyl groups, carbamyl groups, sulfo groups, sulfamyl groups, acylamide groups, ureido groups, sulfonamido groups, amino groups, nitro groups, thiocyano groups, cyano groups, hydroxyl groups, acyl groups, aryloxycarbonyl groups, acylamino groups, alkoxysulfonyl groups, aryloxysulfonyl groups and sulfonamino groups; (4) a condensed aromatic ring having the formula

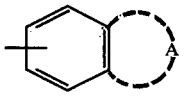

wherein A represents the atoms necessary to form an aromatic condensed ring system.

7. The method of claim 1, wherein $R^1$ is a group represented by the formula:

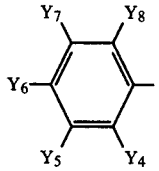

and $R^2$ is a group represented by the formula:

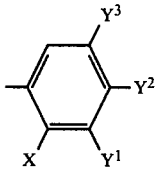

wherein X is a halogen atom, an alkoxy group, an aryloxy group, or a di-substituted amino group, and $Y^1$, $Y^2$ and $Y^3$, which may be the same or different, are each selected from the group consisting of hydrogen atoms, halogen atoms, alkyl groups, alkenyl groups, alkoxy groups, aryl groups, aryloxy groups, alkylcarbonyl groups, arylcarbonyl groups, alkylsulfonyl groups, arylsulfonyl groups, carboxyl groups, alkoxycarbonyl groups, carbamyl groups, sulfo groups, sulfamyl groups, acylamino groups, ureido groups, sulfonamido groups, amino groups, nitro groups and cyano groups, $Y^4$ and $Y^8$, which may be the same or different, are each selected from the the group consisting of hydrogen atoms, alkyl groups and alkoxy groups, $Y^5$, $Y^6$ and $Y^7$, which may be the same or different, are each selected from the group consisting of hydrogen atoms, alkyl atoms, alkoxy groups, aryloxy groups, amino groups, alkylamino groups and acylamino groups.

8. A silver halide emulsion containing a yellow dye-forming coupler of the formula:

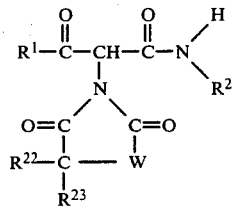

wherein $R^1$ represents an aryl group; $R^2$ represents an aryl group or a heterocyclic group; W represents an oxygen atom or a sulfur atom; and $R^{22}$ and $R^{23}$, which may be he same or different, each represents a hydrogen atom, a halogen atom, an alkyl group, an alkoxy group, an aryl group, an aryloxy group, a sulfo group or a carboxyl group.

9. The silver halide emulsion of claim 8, wherein

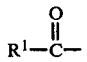

represents an α-benzoyl group; $R^2$ represents an aryl group; W represents an oxygen atom; and $R^{22}$ and $R^{23}$, which may be the same or different, each represents a hydrogen atom, an alkyl group or an aryl group.

10. The silver halide emulsion of claim 8, wherein

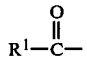

represents an α-benzoyl group; $R^2$ represents an aryl group; W represents a sulfur atom; and $R^{22}$ and $R^{23}$, which may be the same or different, each represents a hydrogen atom, an alkyl group or an aryl group.

11. The silver halide emulsion of claim 8, wherein W represents an oxygen atom and $R^{22}$ and $R^{23}$ each represents a methyl group.

12. The silver halide emulsion of claim 8, wherein W represents a sulfur atom and $R^{22}$ and $R^{23}$ each represents a methyl group.

13. The silver halide emulsion of claim 9, wherein $R^1$ represents (1) a phenyl group; (2) a substituted phenyl group wherein said substituents are one or more members from the group consisting of halogen atoms, alkyl groups, alkenyl groups, alkoxy groups, aryl groups, aryloxy groups, alkylcarbonyl groups, arylcarbonyl groups, alkylsulfonyl groups, arylsulfonyl groups, carboxyl groups, thiocyano groups, alkoxycarbonyl groups, carbamyl groups, sulfo groups, sulfamyl groups, acylamino groups, ureido groups, sulfonamido groups, amino groups, nitro groups, cyano groups, hydroxyl groups, acyl groups, aryloxycarbonyl groups, alkoxysulfonyl groups, aryloxysulfonyl groups and sulfonamino groups; or (3) a condensed aromatic ring having the formula

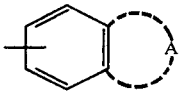

wherein A represents the atoms necessary to form an aromatic condensed ring system; and $R^2$ represents (1) a phenyl group; (2) a substituted phenyl group, wherein said substituents are one or more members from the group consisting of halogen atoms, alkyl groups, alkenyl groups, alkoxy groups, aryl groups, aryloxy groups, arylcarbonyl groups, alkylcarbonyl groups, alkylsulfonyl groups, arylsulfonyl groups, carboxyl groups, thiocyano groups, alkoxycarbonyl groups, carbamyl groups, sulfo groups, sulfamyl groups, acylamino groups, ureido groups, sulfonamido groups, amino groups, nitro groups, cyano groups, hydroxyl groups, acyl groups, aryloxycarbonyl groups, alkoxysulfonyl groups, aryloxysulfonyl groups and sulfonamino groups; (3) a heterocyclic group bound to said

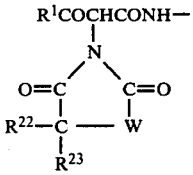

group in the general formula through a carbon atom in said heterocyclic group which is part of the conjugated electron system and selected from the group consisting of the thiophenes, furans, pyrans, chromenes, pyrroles, pyrazoles, pyridines, pyrazines, pyrimidines, pyridazines, indolidines, perimidines, thiazoles, imidazoles, oxazoles, 1,3,5-triazines and the oxazines; and the substituted derivatives thereof, said substituents being selected from the group consisting of halogen atoms, alkyl groups, alkenyl groups, alkoxy groups, aryl groups, aryloxy groups, alkylcarbonyl groups, arylcarbonyl groups, alkylsulfonyl groups, arylsulfonyl groups, carboxyl groups, alkoxycarbonyl groups, carbamyl groups, sulfo groups, sulfamyl groups, acylamide groups, ureido groups, sulfonamide groups, amino groups, nitro groups, thiocyano groups, cyano groups, hydroxyl groups, acyl groups, aryloxycarbonyl groups, acylamino groups, alkoxysulfonyl groups, aryloxysulfonyl groups and sulfonamino groups; (4) a condensed aromatic ring having the formula

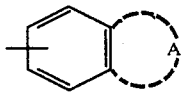

wherein A represents the atoms necessary to form an aromatic condensed ring system.

14. The silver halide emulsion of claim 8, wherein $R^1$ is a group represented by the formula:

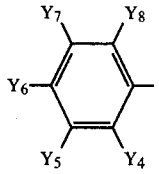

and $R^2$ is a group represented by the formula:

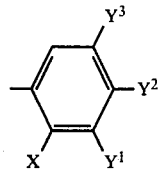

wherein X is a halogen atom, an alkoxy group, an aryloxy group, or a di-substituted amino group, and $Y^1$, $Y^2$ and $Y^3$, which may be the same or different, are each selected from the group consisting of hydrogen atoms, halogen atoms, alkyl groups, alkenyl groups, alkoxy groups, aryl groups, aryloxy groups, alkylcarbonyl groups, arylcarbonyl groups, alkylsulfonyl groups, arylsulfonyl groups, carboxyl groups, alkoxycarbonyl groups, carbamyl groups, sulfo groups, sulfamyl groups, acylamino groups, ureido groups, sulfonamido groups, amino groups, nitro groups and cyano groups, $Y^4$ and $Y^8$, which may be the same or different, are each selected from the the group consisting of hydrogen atoms, alkyl groups and alkoxy groups, $Y^5$, $Y^6$ and $Y^7$, which may be the same or different, are each selected from the group consisting of hydrogen atoms, alkyl atoms, alkoxy groups, aryloxy groups, amino groups, alkylamino groups and acylamino groups.

15. A photographic light-sensitive element comprising a support having coated thereon at least one silver halide emulsion layer containing a yellow dye-forming coupler having the following formula:

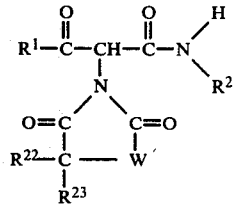

wherein $R^1$ represents an aryl group; $R^2$ represents an aryl group or a heterocyclic group; W represents an oxygen atom or a sulfur atom; and $R^{22}$ and $R^{23}$, which may be the same or different, each represents a hydrogen atom, a halogen atom, an alkyl group, an alkoxy group, an aryl group, an aryloxy group, a sulfo group or a carboxyl group.

16. The light-sensitive element of claim 15, wherein

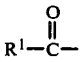

represents an α-benzoyl group; $R^2$ represents an aryl group; W represents an oxygen atom; and $R^{22}$ and $R^{23}$, which may be the same or different, each represents a hydrogen atom, an alkyl group or an aryl group.

17. The light-sensitive element of claim 15, wherein

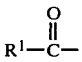

represents an α-benzoyl group; $R^2$ represents an aryl group; W represents a sulfur group; and $R^{22}$ and $R^{23}$, which may be the same or different, each represents a hydrogen atom, an alkyl group or an aryl group.

18. The photographic light-sensitive element of claim 15, wherein W represents an oxygen atom and $R^{22}$ and $R^{23}$ each represents a methyl group.

19. The photographic light-sensitive element of claim 15, wherein W represents a sulfur atom and $R^{22}$ and $R^{23}$ each represents a methyl group.

20. A photographic light-sensitive element as claimed in claim 16, wherein $R^1$ represents (1) a phenyl group; (2) a substituted phenyl group, wherein said substituents are one or more members from the group consisting of halogen atoms; alkyl groups, alkenyl groups, alkoxy groups, aryl groups, aryloxy groups, alkylcarbonyl groups, arylcarbonyl groups, alkylsulfonyl groups, arylsulfonyl groups, carboxyl groups, thiocyano groups, alkoxycarbonyl groups, carbamyl groups, sulfo groups, sulfamyl groups, acylamino groups, ureido groups, sulfonamido groups, amino groups, nitro groups, cyano groups, hydroxyl groups, acyl groups, aryloxycarbonyl groups, alkoxysulfonyl groups, aryloxysulfonyl groups and sulfonamino groups; and (3) a condensed aromatic ring having the formula

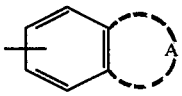

wherein A represents the atoms necessary to form an aromatic condensed ring system; and $R^2$ represents (1) a phenyl group; (2) a substituted phenyl group, wherein said substituents are one or more members from the group consisting of halogen atoms, alkyl groups, alkenyl groups, alkoxy groups, aryl groups, aryloxy groups, arylcarbonyl groups, alkylcarbonyl groups, alkylsulfonyl groups, arylsulfonyl groups, carboxyl groups, thiocyano groups, alkoxycarbonyl groups, carbamyl groups, sulfo groups, sulfamyl groups, acylamino groups, ureido groups, sulfonamido groups, amino groups, nitro groups, cyano groups, hydroxyl groups, acyl groups, aryloxycarbonyl groups, alkoxysulfonyl groups, aryloxysulfonyl groups and sulfonamino groups; (3) a heterocyclic group bound to said

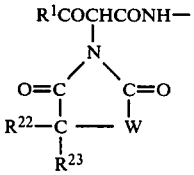

group in the general formula through a carbon atom in said heterocyclic group which is part of the conjugated electron system and selected from the group consisting of the thiophenes, furans, pyrans, chromenes, pyrroles, pyrazoles, pyridines, pyrazines, pyrimidines, pyridazines, indolidines, perimidines, thiazoles, imidazoles, oxazoles, 1,3,5-triazines and the oxazines; and the substituted derivatives thereof, said substituents being selected from the group consisting of halogen atoms, alkyl groups, alkenyl groups, alkoxy groups, aryl groups, aryloxy groups, alkylcarbonyl groups, arylcarbonyl groups, alkylsulfonyl groups, arylsulfonyl groups, carboxyl groups, alkoxycarbonyl groups, carbamyl groups, sulfo groups, sulfamyl groups, acylamide groups, ureido groups, sulfonamido groups, amino groups, nitro groups, thiocyano groups, cyano groups, hydroxyl groups, acyl groups, aryloxycarbonyl groups, acylamino groups, alkoxysulfonyl groups, aryloxysulfonyl groups and sulfonamino groups; (4) a condensed aromatic ring having the formula

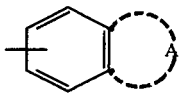

wherein A represents the atoms necessary to form an aromatic condensed ring system.

21. The photographic light-sensitive element as claimed in claim 15, wherein $R^1$ is a group represented by the formula:

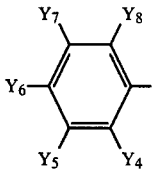

and $R^2$ is a group represented by the formula:

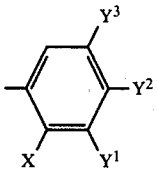

wherein X is a halogen atom, an alkoxy group, an aryloxy group, or a di-substituted amino group, and $Y^1$, $Y^2$ and $Y^3$, which may be the same or different, are each selected from the group consisting of hydrogen atoms, halogen atoms, alkyl groups, alkenyl groups, alkoxy groups, aryl groups, aryloxy groups, alkylcarbonyl groups, arylcarbonyl groups, alkysulfonyl groups, arylsulfonyl groups, carboxyl groups, alkoxycarbonyl groups, carbamyl groups, sulfo groups, sulfamyl groups, acylamino groups, ureido groups, sulfonamido groups, amino groups, nitro groups and cyano groups, $Y^4$ and $Y^8$, which may be the same or different, are each selected from the the group consisting of hydrogen atoms, alkyl groups and alkoxy groups, $Y^5$, $Y^6$ and $Y^7$, which may be the same or different, are each selected from the groups consisting of hydrogen atoms, alkyl atoms, alkoxy groups, aryloxy groups, amino groups, alkylamino groups and acylamino groups.

22. A photographic light-sensitive element comprising a support having coated thereon at least one silver halide emulsion layer containing a yellow dye forming coupler having the following formula:

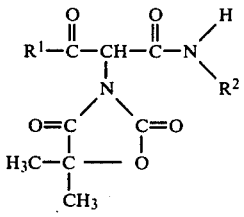

wherein $R^1$ is an aryl group and $R^2$ is an aryl group or an heterocyclic group.

23. A silver halide emulsion containing a yellow dye-forming coupler of the formula

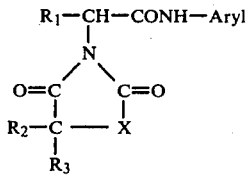

wherein X is oxygen or sulfur, $R_1$ is α-benzoyl, and $R_2$ and $R_3$ are each hydrogen or alkyl.

24. A silver halide emulsion containing a yellow dye-forming coupler of the formula

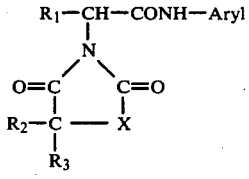

wherein X is oxygen, $R_1$ is α-benzoyl, and $R_2$ and $R_3$ are each hydrogen, alkyl or aryl.

25. A silver halide emulsion containing a yellow dye-forming coupler of the formula

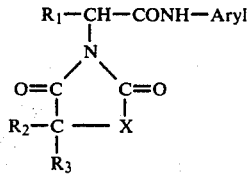

wherein X is sulfur, $R_1$ is α-benzoyl, and $R_2$ and $R_3$ are each hydrogen, alkyl or aryl.

* * * * *